US008834024B2

(12) United States Patent
Umenaka

(10) Patent No.: US 8,834,024 B2
(45) Date of Patent: Sep. 16, 2014

(54) SELF-STANDING BAG, PRODUCTION METHOD THEREOF, AND SELF-STANDING BAG HAVING CONTENT THEREIN

(75) Inventor: Kazuhiro Umenaka, Fujimino (JP)

(73) Assignee: Hosokawa Yoko Co., Ltd., Tokyo (JP)

( * ) Notice: Subject to any disclaimer, the term of this patent is extended or adjusted under 35 U.S.C. 154(b) by 183 days.

(21) Appl. No.: 13/635,516

(22) PCT Filed: Mar. 18, 2011

(86) PCT No.: PCT/JP2011/056637

§ 371 (c)(1),
(2), (4) Date: Sep. 17, 2012

(87) PCT Pub. No.: WO2011/115270

PCT Pub. Date: Sep. 22, 2011

(65) Prior Publication Data

US 2013/0011085 A1 Jan. 10, 2013

(30) Foreign Application Priority Data

Mar. 19, 2010 (JP) ..... 2010-064464

(51) Int. Cl.

| | |
|---|---|
| ***B65D 30/16*** | (2006.01) |
| ***B65D 30/10*** | (2006.01) |
| ***B65D 30/18*** | (2006.01) |
| ***B31B 1/60*** | (2006.01) |
| ***B31B 1/26*** | (2006.01) |
| ***B31B 1/62*** | (2006.01) |
| ***B65D 75/00*** | (2006.01) |
| ***B65D 75/58*** | (2006.01) |

(52) U.S. Cl.

CPC ..... *B65D 75/008* (2013.01); *B65D 2231/002* (2013.01); *B65D 75/5883* (2013.01); *Y10S 383/906* (2013.01)

USPC ..... 383/104; 383/121; 383/122; 383/906; 493/210; 493/243; 493/264

(58) Field of Classification Search

CPC ..... B65D 75/008; B65D 33/02; B31B 19/90

USPC ..... 383/104, 120–122, 107, 108, 119, 903, 383/906; 493/210, 243, 264

See application file for complete search history.

(56) References Cited

U.S. PATENT DOCUMENTS

| | | | | |
|---|---|---|---|---|
| 6,077,208 | A | 6/2000 | Larkin et al. | |
| 8,137,254 | B2 * | 3/2012 | DeSmedt | 493/231 |

(Continued)

FOREIGN PATENT DOCUMENTS

| | | | |
|---|---|---|---|
| CN | 1919693 | A | 2/2007 |
| CN | 201385867 | Y | 1/2010 |

(Continued)

OTHER PUBLICATIONS

Chinese Office Action, dated Nov. 22, 2013, issued in corresponding Chinese Patent Application No. 201180020091.X.

(Continued)

*Primary Examiner* — Jes F Pascua
(74) *Attorney, Agent, or Firm* — Sughrue Mion, PLLC

(57) ABSTRACT

A self-standing bag (1) including a barrel portion (10) having a front surface portion (11) and a back surface portion (12); and a bottom portion (20) formed by a bottom member folded in half, wherein each side edge of the bottom member is folded back at edges (14, 15) of the barrel portion (10), each side edge area of the bottom member is attached on an inner surface of the back surface portion (12) of the barrel portion (10), the entire circumference of a lower end of barrel portion (10) is adhered to a lower end (10*c*) of the barrel portion (10), and the attachment of the side edges of the bottom member to the inner surface of the barrel portion (10) is performed by adhesive members (41, 42) so as to cover the edges of the bottom member. Also, Disclosed are a production method of the self-standing bag (1) and a self-standing bag having content in the self-standing bag (1).

8 Claims, 22 Drawing Sheets

(56) References Cited

U.S. PATENT DOCUMENTS

| | | | | |
|---|---|---|---|---|
| 2007/0133908 | A1* | 6/2007 | Bruns | 383/95 |
| 2009/0175565 | A1* | 7/2009 | Totani | 383/120 |
| 2010/0142858 | A1* | 6/2010 | Kruse et al. | 383/5 |
| 2011/0091140 | A1* | 4/2011 | Wedi et al. | 383/120 |
| 2012/0195532 | A1* | 8/2012 | Koesters | 383/120 |

FOREIGN PATENT DOCUMENTS

| | | | | | |
|---|---|---|---|---|---|
| JP | 61-080237 | U | | 5/1986 | |
| JP | 11198947 | A | * | 7/1999 | B65D 30/16 |
| JP | 2004-161288 | A | | 6/2004 | |
| JP | 2005-162308 | A | | 6/2005 | |
| JP | 2009090987 | A | * | 4/2009 | |
| JP | 2010-10674 | A | | 1/2010 | |
| JP | 2010-105741 | A | | 5/2010 | |
| JP | 2012192948 | A | * | 10/2012 | |
| JP | 2013116611 | A | * | 6/2013 | |
| WO | 2004/085275 | A1 | | 10/2004 | |

OTHER PUBLICATIONS

Decision to Grant, dated Oct. 25, 2013, issued in Korean Patent Application No. 10-2012-7023560.

International Search Report for PCT/JP2011/056637, dated Apr. 26, 2011.

* cited by examiner

SELF-STANDING BAG, PRODUCTION METHOD THEREOF, AND SELF-STANDING BAG HAVING CONTENT THEREIN

CROSS REFERENCE TO RELATED APPLICATIONS

This application is a National Stage of International Application No. PCT/JP2011/056637, filed on Mar. 18, 2011, which claims priority from Japanese Patent Application No. 2010-064464, filed Mar. 19, 2010, the contents of all of which are incorporated herein by reference in their entirety.

TECHNICAL FIELD

The present invention relates to a self-standing bag, a production method thereof, and a self-standing bag having content therein. Priority is claimed on Japanese Patent Application No. 2010-064464, filed Mar. 19, 2010, the content of which is incorporated herein by reference.

BACKGROUND ART

As a soft packaging material made of a plastic film, a bag body having self-standing properties, a so-called self-standing bag is known. As the self-standing bag, a self-standing bag formed in such a manner that side edges of two barrel members and side edges of a bottom member are heat-sealed together, and lower ends of two barrel members are heat-sealed over the entire circumference in a state in which the folded bottom member which forms a bottom portion sets a folding line upward and is inserted between the lower ends of two barrel members which form a barrel portion, can be mentioned. However, in the self-standing bag, a heat-sealed portion between the side edges of two barrel members formed on edges of the barrel portion may feel like a knife edge. For this reason, when the barrel portion of the self-standing bag is grasped using one's hand, there may be an uncomfortable feeling.

In Patent Document 1, to eliminate such uncomfortable feeling when the barrel portion is grasped using the hand, as shown in FIG. 23, a self-standing bag 101 that includes a barrel portion 110 with a flattened cylindrical shape which has a front surface portion 111 and a back surface portion 112 and in which creases are provided on both sides, and a bottom portion 120 which is provided on a lower end of the barrel portion 110 is shown.

The barrel portion 110 is formed in a flattened cylindrical shape by matching the side edges of two rectangular barrel members. That is to say, the barrel portion 110 with the flattened cylindrical shape that has the front surface portion 111 and the back surface portion 112 is formed by heat-sealing the side edges of the barrel portion 110 to form a back seal 113. The barrel member which forms the barrel portion 110 is configured such that an inner surface of the barrel portion 110 is made up of a sealant layer having heat-sealing properties and an outer surface of the barrel portion 110 is made up of a laminated film of basic material layers.

As shown in FIG. 24A, the bottom portion 120 is formed with a rectangular bottom member 120A in which the basic material layer without heat-sealing properties and the sealant layer with heat-sealing properties are laminated. As shown in FIG. 24A, side portions 121 and 122 of the bottom member 120A are folded along folding lines L121 and L122 so that the basic material layers of the side portions 121 and 122 and a basic material layer of a center portion 123 are in close contact. As shown in FIG. 24B and FIG. 24C, the bottom member

120A of which the side portions 121 and 122 are folded is further folded along a folding line L123 so that the side portions 121 and 122 are folded inside. At this time, a contact surface of a first side portion 121*a* and a second side portion 121*b* in the folded side portion 121 is made up of the sealant layer. In addition, a contact surface of a first side portion 122*a* and a second side portion 122*b* in the folded side portion 122 is made up of the sealant layer. In addition, a contact surface of the center portions 123 between the folded side portions 121 and 122 is made up of the basic material layer. As shown in FIG. 24C, facing surfaces of the first side portion 121*a* and the second side portion 121*b* in the folded side portion 121 are heat-sealed, and the facing surfaces of the first side portion 122*a* and the second side portion 122*b* in the folded side portion 122 are heat-sealed. Then, as shown in FIG. 24D, the bottom member 120A is formed in a pouch shape with a lower end 120*c* opened. The pouch-shaped bottom member 120A has an outer surface side made up of the sealant layer.

As shown in FIG. 23, the pouch-shaped bottom member 120A is arranged in the barrel portion 110 so that the lower end 120*c* of the bottom member 120A matches a lower end 110*c* of the barrel portion 110. Then, by heat-sealing the lower end 120*c* of the bottom member 120A and a lower end 110*c* of the barrel portion 110 at a heat-sealed portion HS101, the side edges 120*a* and 120*b* and the lower end 120*c* of the bottom member 120A are adhered to the inner surface of the barrel portion 110 to form the bottom portion 120.

The barrel portion 110 of the self-standing bag 101 is formed with one barrel member. Due to this, the heat-sealed portion which is formed by heat-sealing the side edges of the barrel member in edges 110*a* and 110*b* of the barrel portion 110 is not present. As a result, even when barrel portion 110 is grasped using the hand, any uncomfortable feeling is reduced.

As shown in FIG. 25, in the bottom portion 120 of the self-standing bag 101, the facing surfaces of the side portion 121 folded inside and the bottom portion 120 are not adhered by heat-sealing since the basic material layers contact each other. Therefore, the vicinity of the side edge 110*a* of the barrel portion 110 is spread, and a shape which takes on roundness is obtained. As a result, even when the vicinity of the bottom portion 120 of the barrel portion 110 is grasped using the hand, any uncomfortable feeling is reduced.

Since the shape which takes on roundness can be obtained in the side portion 122 like the side portion 121, any uncomfortable feeling is reduced.

PRIOR ART DOCUMENTS

Patent Documents

[Patent Document 1] Japanese Unexamined Patent Application, First Publication No. 2004-161288

SUMMARY OF THE INVENTION

Problems to be Solved by the Invention

As shown in FIG. 25, the first side portion 121*a* and the second side portion 121*b* of the side portion 121 folded inside in the self-standing bag 101 are adhered to the barrel portion 110 in a region f where the side edge 120*a* of the bottom portion 120 and the side edge 110*a* of the barrel portion 110 are adhered. It is necessary that the first side portion 121*a* and the second side portion 121*b* of the side portion 121 be adhered to the barrel portion 110 from an upper end to the lower ends of the bottom member to prevent the leakage of content in the region f. In the self-standing bag 101, in particular, it is necessary that the upper end section of the side edge 120*a* of the bottom portion 120 be adhered up to the upper end of the bottom member. Therefore, heat-sealing is performed up to a region g above the upper end of the side edge 120*a* in the bottom portion 120 as shown in FIG. 23. However, when the heat-sealing is performed up to the region g, a section where the inner surfaces of the barrel portion 110 are adhered becomes hard in the region g. Then, the heat-sealed portion feels like a knife edge, and when the barrel portion 110 is grasped using the hand, there is an uncomfortable feeling. Further, the appearance of the bag is deteriorated. In the side edge 120*b* of the bottom portion 120, there is an uncomfortable feeling like the side edge 120*a* of the bottom portion 120. In addition, the appearance of the bag is deteriorated.

As shown in FIG. 26, the four sheets of film which form the pouch-shaped bottom member 120 and the two sheets of film which form the barrel portion 110 overlap each other in an upper end section h of the side edge 120*a* in the bottom portion 120. In addition, the two sheets of the film which form the barrel portion 110 overlap each other in the region g above the upper end section h of the side edge 120*a* in the bottom portion 120. Therefore, there is a large step difference at a boundary section between the upper end section h and the region g. As a result, point sealing which intensively adheres the section with the large step difference is performed to prevent the leakage of content due to adhesive defects. The point sealing is a sealing in which heat-sealing is performed on a relatively small region under conditions where sealing strength becomes higher than the vicinity of the region such as high temperature and high pressure. However, when content is accommodated in the bag, a load of the content is easily concentrated on the vicinity of the side edge 120*a* of the bottom portion 120. For this reason, even when the point sealing is performed, if the bag is torn at the boundary section, and the content may leak out. Further, even when the point sealing is performed, the section where the inner surfaces of the barrel portion 110 are adhered feel like a knife edge, and when the barrel portion 110 is grasped using the hand, there is uncomfortable feeling. In the side edge 120*b* of the bottom portion 120, there is an uncomfortable feeling in the same way as the side edge 120*a* of the bottom portion 120.

As shown in FIG. 25, four sheets of the film which form the bottom portion 120 and two sheets of the film which form the barrel portion 110 overlap each other at a section where the side portions 121 are folded in an adhesion section of the lower end 110*c* in the barrel portion 110 and the lower end 120*c* in the bottom portion 120. On the other hand, two sheets of the film which form the barrel portion 110 and two sheets of the film which form the pouch-shaped bottom member 120 overlap each other in a center in the width direction. Therefore, a step difference is generated at a boundary section between the section where the side portions 121 are folded and the center in the width direction. As a result, there is concern that adhesive defects may occur in the heat-sealing of the barrel portion 110 and the bottom portion 120 in the regions i and j, and the content may leak out. There is concern that, in the same manner as the side portion 121 of bottom portion 120, adhesive defects may occur and content may leak out in the side portion 122 of the bottom portion 120.

An object of the present invention is to provide a self-standing bag which is capable of suppressing an uncomfortable feeling when the barrel portion of the self-standing bag is grasped using the hand and the leakage of content due to adhesive defects and has a good appearance, and a production method thereof.

In addition, another object of the present invention is to provide a self-standing bag having content therein in which the content is accommodated in the self-standing bag.

Means for Solving the Problem

The present invention has the following configurations to address the above-mentioned problems.

[1] A self-standing bag includes a barrel portion where a barrel member is formed in a flattened cylindrical shape and which has a front surface portion and a back surface portion; and a bottom portion where a bottom member folded in half sets a folding line as an upper side and is attached to a lower end in the barrel portion, wherein side edge areas of the bottom member are folded back at edges of the barrel portion. Side edges of the bottom member are attached to an inner surface of the front surface portion or the back surface portion of the barrel portion. Lower ends of the bottom member are adhered to the lower end of the barrel portion over the entire circumference of the barrel portion. Attaching the side edges of the bottom member to the inner surface of the barrel portion is performed by an adhesive member to adhere the side edges of the bottom member and the barrel portion so as to cover the side edges of the bottom member.

[2] A self-standing bag includes a barrel portion where a barrel member is formed in a flattened cylindrical shape and which has a front surface portion and a back surface portion; and a bottom portion where a bottom member with a flattened pouch shape opened at a lower end is attached in the barrel portion such that the lower ends of the bottom member match a lower end of the barrel portion, wherein side edge areas of the bottom member are folded back at edges of the barrel portion. Side edges of the bottom member are attached to an inner surface of the front surface portion or the back surface portion of the barrel portion. Lower ends of the bottom member are adhered to the lower end of the barrel portion over the entire circumference of the barrel portion. Attaching the side edges of the bottom member to the inner surface of the barrel portion is performed by an adhesive member to adhere the side edges of the bottom member to the barrel portion so as to cover the side edges of the bottom member.

[3] The self-standing bag according to [1] or [2], wherein both side edges of the bottom member folded back at the edges of the barrel portion correspond with a junction position of the side edges of the cylindrical-shaped barrel member in the barrel portion, and joining the side edges of the barrel member by the adhesive member and adhering the side edges of the bottom member to the barrel portion are performed by the adhesive member.

[4] The self-standing bag according to any one of [1] to [3], wherein a section adhered to the adhesive member of the barrel portion is only the front surface portion or the back surface portion of the barrel portion where the side edges of the bottom member are attached.

[5] The self-standing bag according to any one of [1] to [4], wherein a spout which pours out accommodated content is attached to the barrel portion.

[6] A self-standing bag having content therein in which the content is accommodated in the self-standing bag according to any one of [1] to [5].

[7] A production method of a self-standing bag including:

(I) arranging a film-like bottom member which sets a folding line as an upper end and is folded in half or a film-like bottom member formed in a flattened pouch shape with lower ends opened on a film-like barrel member so that a lower end of the barrel member matches the lower ends of the bottom member;

(II) arranging an adhesive member to adhere the barrel member and the bottom member so as to cover the side edges of the bottom member arranged on the barrel member;

(III) adhering the side edges of the bottom member and the barrel member, and the adhesive member to attach the side edges of the bottom member to the barrel member;

(IV) forming a barrel portion by folding back side edge areas of the barrel member with the side edge areas of the bottom member, and adhering the side edges of the barrel member such that a surface where the bottom member is adhered forms an inner surface and folding lines are formed in the center from both side edges of the bottom member; and (V) forming a bottom portion by adhering the lower ends of the bottom member and the lower end of the barrel portion over the entire circumference of the barrel portion.

[8] The production method of a self-standing bag according to [7] further includes (VI) performing point sealing on a step difference section generated at a boundary of a section formed by overlapping the bottom member and the barrel member and a section formed with only the barrel member in upper ends of the side edge areas in the bottom member after (II) or (III).

Effects of the Invention

A self-standing bag of the present invention does not have an uncomfortable feeling when grasped using the hand, can suppress the leakage of content due to adhesive defects or fractures at an adhesion section, and has a good appearance.

Further, a production method of a self-standing bag according to the present invention can produce a self-standing bag which does not have an uncomfortable feeling when grasped using the hand, can suppress the leakage of content due to adhesive defects or fractures at an adhesion section, and has a good appearance.

Furthermore, a self-standing bag having content therein accommodates the content in the self-standing bag of the present invention.

DESCRIPTION OF EMBODIMENTS

Hereinafter, as an example of an embodiment in the present invention, a self-standing bag having a spout which pours accommodated content out will be described in detail.

(First Embodiment)

Figure 1:
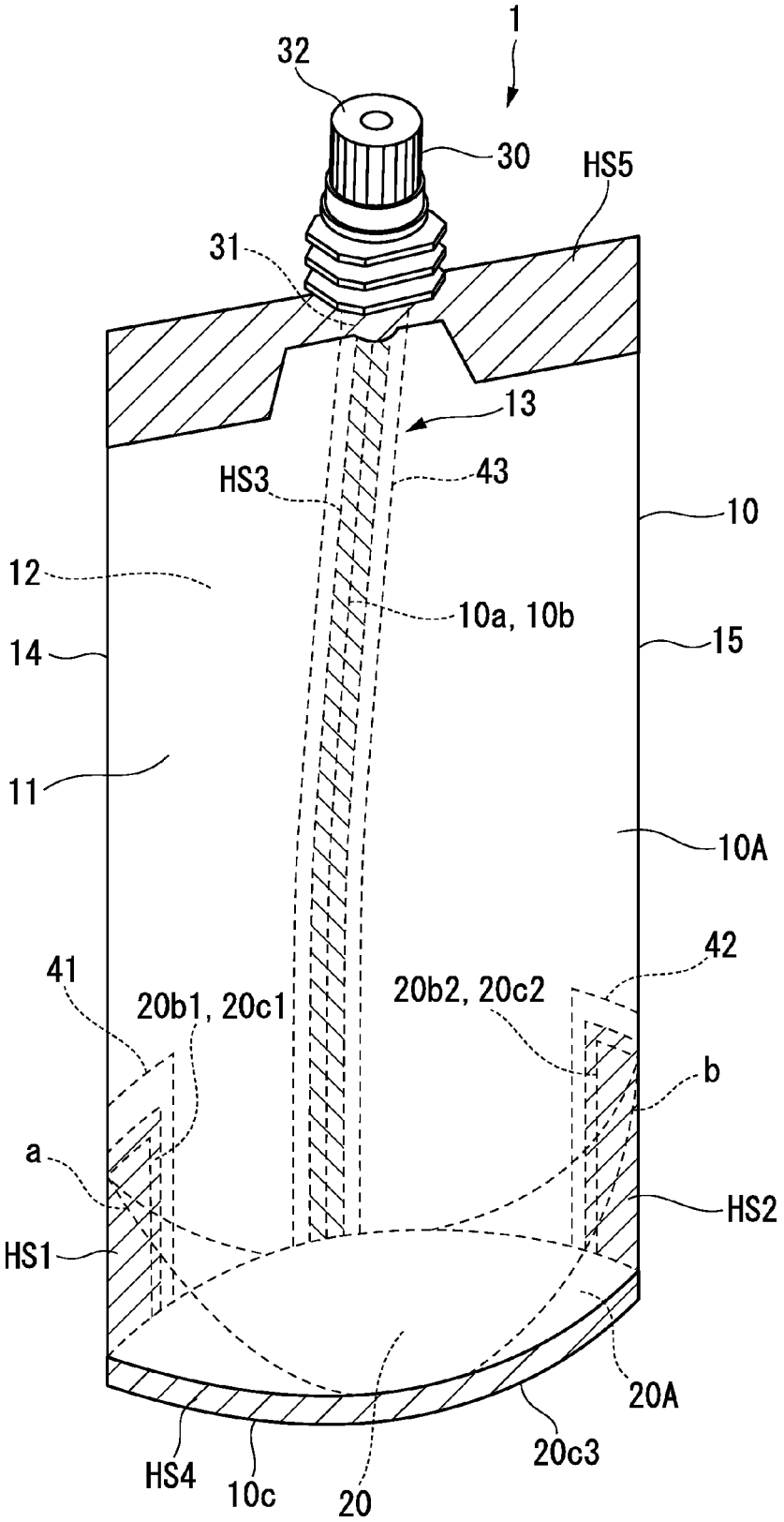
FIG. 1 is a perspective view showing a self-standing bag accommodating content therein according to an embodiment of the present invention.
Figure 2:
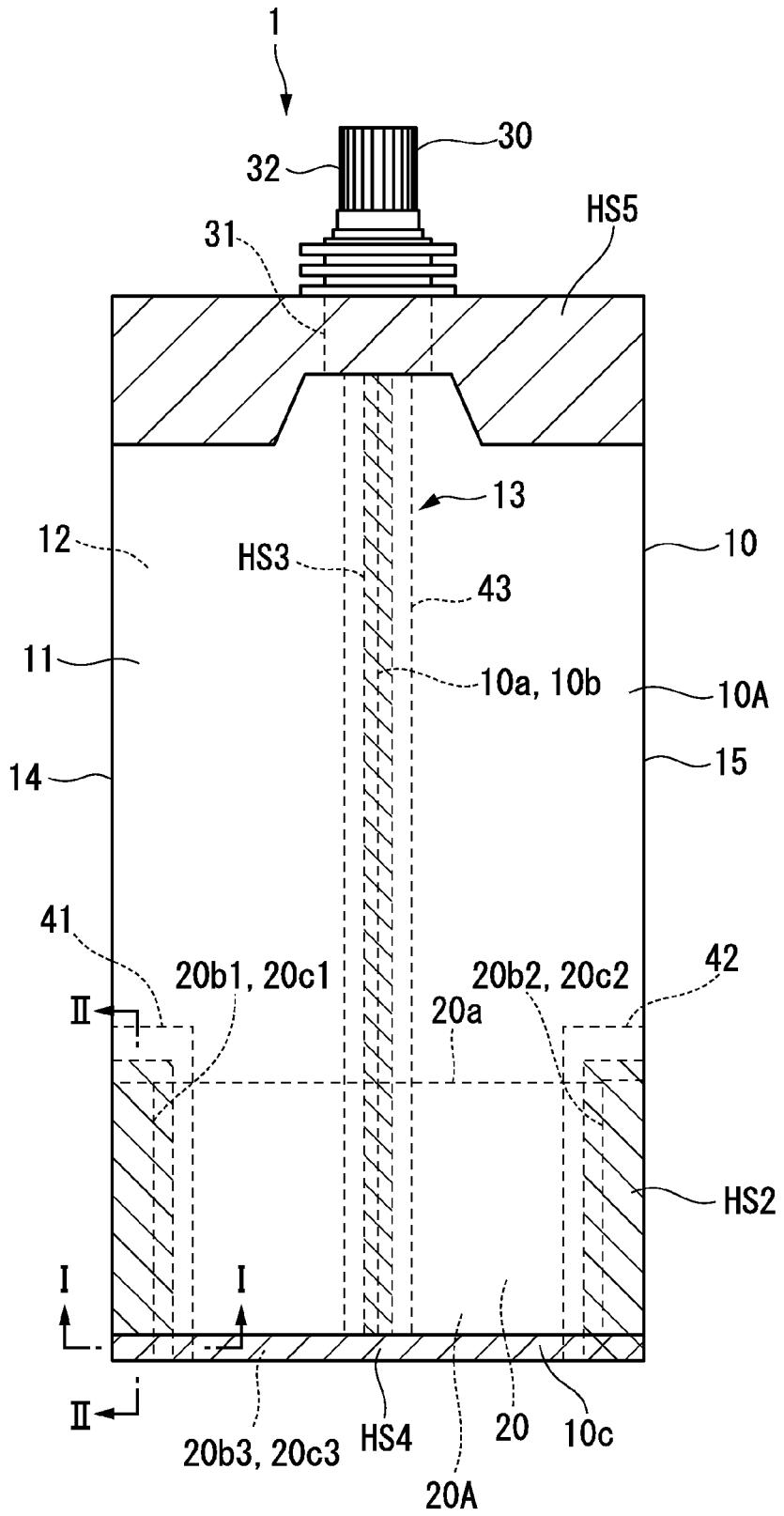
FIG. 2 is a front view showing a flattened state of the self-standing bag according to the embodiment of the present invention.

FIG. 1 is a perspective view showing a self-standing bag 1 accommodating content therein according to the embodiment of the present invention. FIG. 2 is a front view showing a flattened state of the self-standing bag 1 in which the content is not accommodated.

The self-standing bag 1 according to the embodiment has self-standing properties. As shown in FIGS. 1 and 2, the self-standing bag 1 according to the embodiment includes a barrel portion 10 which has a front surface portion 11 and a back surface portion 12, a bottom portion 20 which is provided on the lower end of the barrel portion 10, and a spout 30 which is provided on the upper end of the barrel portion 10 and pours out accommodated content. The self-standing bag 1 is capable of accommodating content inside, and pouring out the accommodated content from the spout 30.

Figure 3:
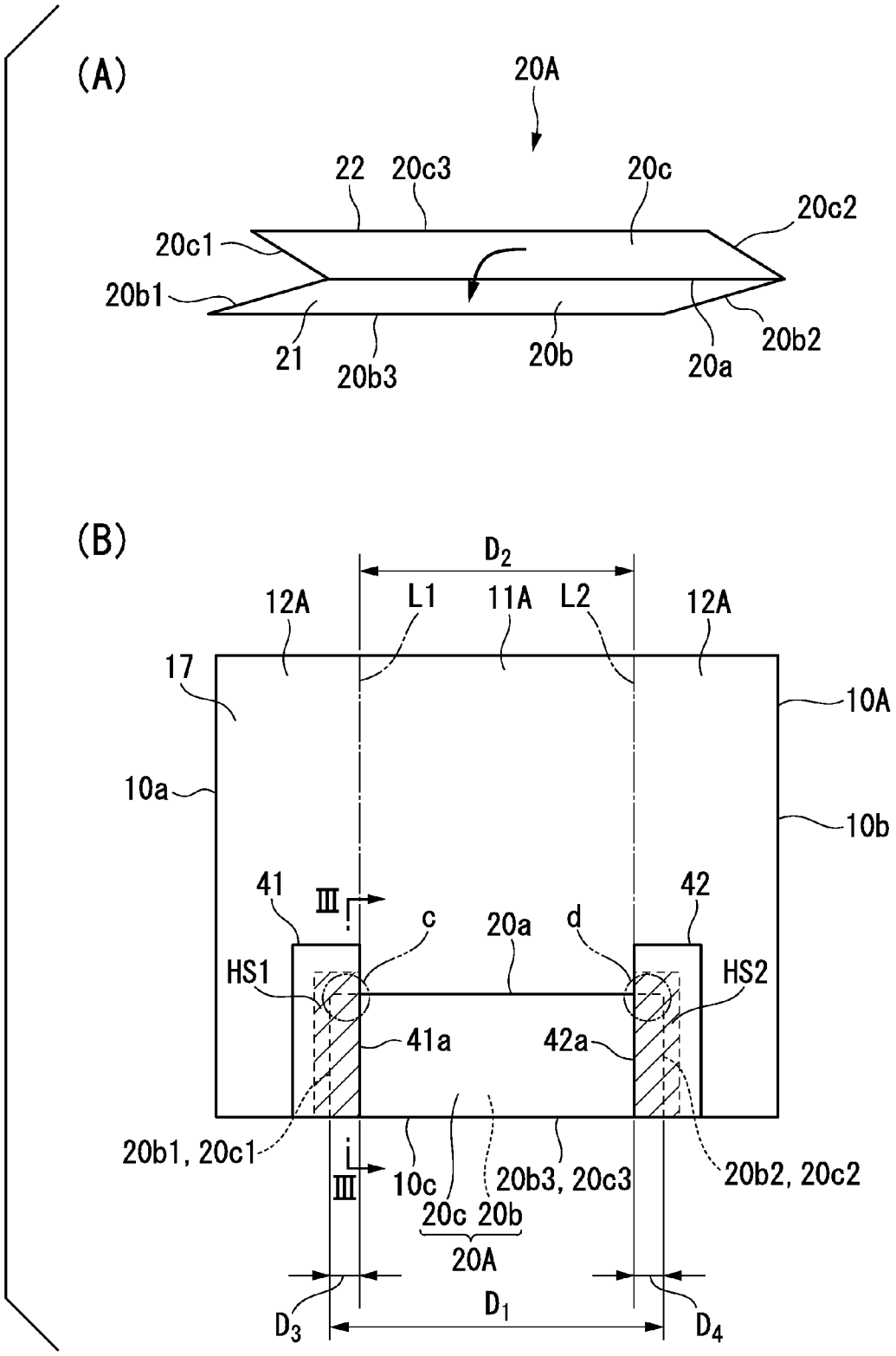
FIG. 3A is a perspective view showing a process of producing a self-standing bag of the present invention.
FIG. 3B is a plan view showing a process of producing a self-standing bag of the present invention.

A rectangular barrel member 10A illustrated in FIG. 3B is folded back along folding lines L1 and L2. As shown in FIGS. 1 and 2, a barrel member 10A is formed in a flattened cylindrical shape by heat-sealing side edges 10*a* and 10*b* of the barrel member 10A at a heat-sealed portion HS3 in a state in which the side edges 10*a* and 10*b* are overlapped with an adhesive member 43. Thus, the barrel portion 10 having the front surface portion 11 and the back surface portion 12 is formed. A section 11A between the folding line L1 and the folding line L2 of the barrel member 10A forms the front surface portion 11 of the barrel portion 10, and a section 12A between the folding line L1 and the side edge 10*a* and a section 12A between the folding line L2 and the side edge 10*b* in the barrel member 10A are matched to form the back surface portion 12 of the barrel portion 10. The folding lines L1 and L2 in the barrel member 10A respectively form edges 14 and 15 of the barrel portion 10.

A rectangular bottom member 20A illustrated in FIG. 3A is folded in half along a folding line 20*a*. As shown in FIG. 2, the bottom member 20A sets the folding line 20*a* as an upper side, and lower ends of the bottom member 20A are attached to a lower end 10*c* of the barrel portion 10 to form a bottom portion 20. The bottom member 20A folded in half is partitioned into a first bottom surface portion 20*b* and a second bottom surface portion 20*c* as shown in FIG. 3A. In a state in which the bottom member is folded in half, as shown in FIG. 3B, a side edge 20*b*1 of the first bottom surface portion 20*b* matches a side edge 20*c*1 of the second bottom surface portion 20*c*, a side edge 20*b*2 of the first bottom surface portion 20*b* matches a side edge 20*c*2 of the second bottom surface portion 20*c*, and a lower end 20*b*3 of the first bottom surface portion 20*b* matches a lower end 20*c*3 of the second bottom surface portion 20*c*. At this time, an inner surface of the barrel member 10A and the first bottom surface portion 20*b* of the bottom member 20A face each other.

Side edge areas of the bottom member 20A are folded back with the barrel member 10A in the edges 14 and 15 of the barrel portion 10. As shown in FIGS. 1 and 2, the side edges 20*b*1 and 20*c*1 are attached on the inner surface of the barrel portion 10 by using an adhesive member 41. The side edges 20*b*2 and 20*c*2 of the bottom member 20A are attached on the inner surface of the barrel portion 10 by using an adhesive member 42.

It is preferable for the barrel member 10A to be a laminated film in which at least a basic material layer and a sealant layer are laminated and of which an innermost layer is formed with the sealant layer.

The basic material layer is preferably a film which has excellent printability, puncture strength, tensile strength, and shock resistance. For example, polyethylene terephthalate, polypropylene, polyamide and ethylene vinyl alcohol copolymer are preferable as the material of the basic material layer. As the basic material layer, a biaxial oriented film or a uniaxial oriented film formed with the above material is preferable. Metals such as aluminum and magnesium, a deposition film in which an oxide such as silicon oxide is deposited, and a coated film in which a coating agent with barrier properties such as polyvinylidene chloride is coated may be used as the film to give barrier properties against oxygen and water vapor. The basic material layer may be a single-layer film. In addition, the basic material layer may a laminated body.

The sealant layer is a heat-sealable layer. As the material of the sealant layer, for example, a high-density polyethylene, low-density polyethylene, linear low-density polyethylene and polypropylene are preferable. Then, as the sealant layer, an unstretched film formed with the above material and a film where the resin is extruded in the form of laminae are preferable.

The laminated film may have an intermediate layer between the basic material layer and the sealant layer, as necessary.

As the intermediate layer, for example, a film which has functionality such as oxygen barrier properties, water vapor barrier properties and tear strength is preferable. As material of the intermediate layer, for example, a metal foil such as aluminum, the deposition film and the coated film are preferable.

The basic material layer, the sealant layer and the laminated film which is made up of the intermediate layer used as necessary can be produced in a known method such as a dry lamination method using an adhesive, and an extrusion lamination method using a thermal adhesive resin.

The barrel member 10A may be a single layer film which is made up of a heat-sealable film.

As the bottom member 20A, a laminated film in which at least a basic material layer and a sealant layer are laminated, and of which an outermost layer is the sealant layer when the bottom member is folded in half is preferable. The basic material layer and the sealant layer of the bottom member 20A are preferably the same member as the basic material layer and the sealant layer exemplified in the barrel member 10A. When the bottom member 20A is the laminated film, the bottom member may have an intermediate layer. It is preferable that the intermediate layer of the bottom member 20A be the same member as the intermediate layer exemplified in the barrel member 10A.

The bottom member 20A and the barrel member 10A may be formed with a film of the same material or a different material. However, it is preferable that the bottom member 20A and the barrel member 10A be laminated films that have sealant layers formed with the same resin from the point that adhering by heat-sealing is possible.

The adhesive member 41 is a member which attaches the side edges 20*b*1 and 20*c*1 of the bottom member 20A to the inner surface of the barrel portion 10. Both surfaces of the adhesive member 41 are formed with a film having heat-sealing properties. As the film with heat-sealing properties, for example, a laminated film of which both surfaces are formed with a sealant layer, a single layer film and co-extrusion film are preferable. From the point of entirely melting and the thickness becoming thinner due to heat by heat-sealing, an adhesive member which is formed with a single-layer synthetic resin film is preferable.

The adhesive member 42 is a member which attaches the side edges 20*b*2 and 20*c*2 of the bottom member 20A to the inner surface of the barrel portion 10. As the adhesive member 42, the same film as the adhesive member 41, particularly, an adhesive member which is formed with a single-layer synthetic resin film is preferable.

Particularly, it is preferable that the adhesive member 41 and the adhesive member 42 be formed with the single-layer synthetic resin film.

In a section where the adhesive member 41 is arranged, a step difference is generated between a section formed by overlapping the bottom member 20A and the barrel member 10A and a section formed with only the barrel member 10A. For this reason, adhesive defects are generated by insufficient heat-sealing of the step difference section and the content may leak out from between side edges 20*b*1 and 20*c*1 and between side edges 20*b*2 and 20*c*2 of the bottom member 20A. However, when the adhesive member 41 is formed with the single-layer synthetic resin film, the adhesive member 41 is melted by the heat from heat-sealing and gets into the step difference section. Due to this, it is difficult for heat-sealing defects to occur. In the same manner, when the adhesive member 42 is formed with the single-layer synthetic resin film, the adhesive member 42 is melted by the heat from heat-sealing and gets into the step difference section between the side edges 20*b*2 and 20*c*2. Therefore, it is difficult for heat-sealing defects to occur.

When the adhesive members 41 and 42 are formed with the single-layer synthetic resin film, the adhesive members 41 and 42 are preferably formed with the same material as the resin which forms the sealant layer of the barrel member 10A and the sealant layer of the bottom member 20A.

The adhesive member 43 is a member which attaches side edges 10*a* and side edges 10*b* of the barrel member 10A. Then, both surfaces of the adhesive member 43 are formed with a film having heat-sealing properties. It is preferable for the adhesive member 43 to be the same member exemplified in the adhesive members 41 and 42. Particularly, from the point of entirely melting and the thickness becoming thinner due to heat by heat-sealing, an adhesive member which is formed with a single-layer synthetic resin film is preferable.

Figure 4:
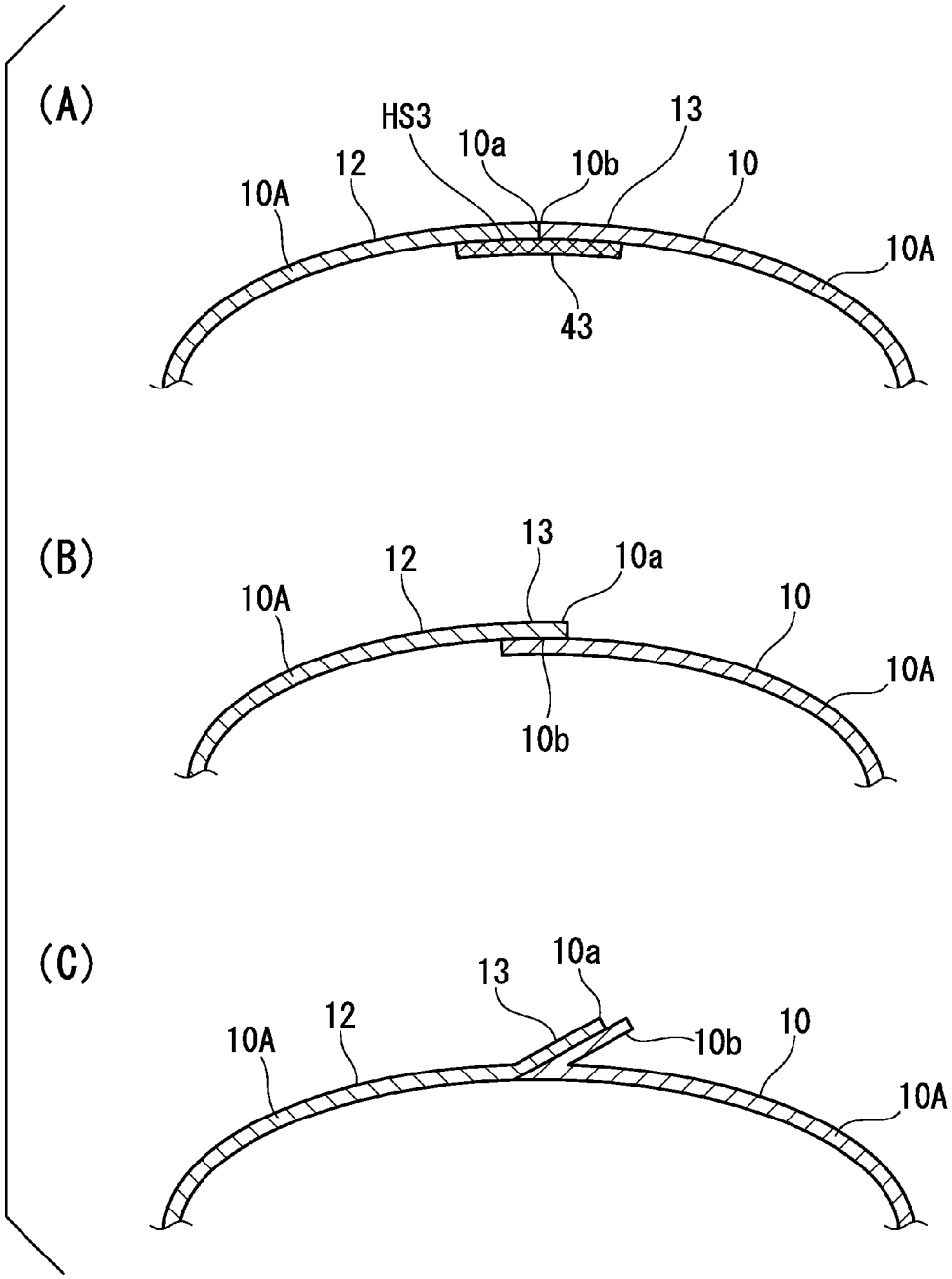
FIG. 4A is a cross-sectional view showing a back seal of the self-standing bag according to the embodiment of the present invention.
FIG. 4B is a cross-sectional view showing the back seal of the self-standing bag according to the embodiment of the present invention.
FIG. 4C is a cross-sectional view showing the back seal of the self-standing bag according to the embodiment of the present invention.

In the self-standing bag 1, as shown in FIGS. 1, 2 and 4A, the side edges 10*a* and 10*b* of the barrel member 10A match. In a state in which the adhesive member 43 and the side edges overlap each other, the side edges are heat-sealed at a heat-sealing portion HS3 and forms a back seal 13. The shape of the back seal 13 is not limited to the shape in which the adhesive member 43 is used. For example, as shown in FIG. 4B, the form of the back seal 13 may be an envelope seal in which an inner surface of the side edge 10*a* and an outer surface of the side edge 10*b* in the barrel member 10A are adhered. In addition, as shown in FIG. 4C, the form of the back seal 13 may be a butt seal in which the inner surfaces of the side edges 10*a* and 10*b* in the barrel member 10A are adhered. The envelope seal and butt seal of the side edges 10*a* and 10*b* may be performed by heat-sealing. Moreover, an adhesive may be used.

The side edges 20*b*1 and 20*c*1 of the bottom member 20A folded in half are folded back at the edge 14 of the barrel portion 10 as shown in FIGS. 1 and 2. Therefore, the side edges 20*b*1 and 20*c*1 are attached to the inner surface of the back surface portion 12. Similarly, the side edges 20*b*2 and 20*c*2 of the bottom member 20A folded in half are folded back at the edge 15 of the barrel portion 10. Then, the side edges 20*b*2 and 20*c*2 are attached to the inner surface of the back surface portion 12.

That is, as shown in FIG. 3B, a length $D_1$ between both side edges of the bottom member 20A fold in half is longer than a width $D_2$ of the section 11A of the barrel member 10A. Further, the side edges 20*b*1 and 20*c*1 of the bottom member 20A are attached to the section 12A of the side edge 10*a* by the folding line L1 of the barrel member 10A. Furthermore, the side edges 20*b*2 and 20*c*2 are attached to the section 12A of the side edge 10*b* by the folding line L2 of the barrel member 10A. Therefore, when the side edges 10*a* and 10*b* of the barrel member 10A are folded back along the folding lines L1 and L2, the side edges 20*b*1 and 20*c*1 and side edges 20*b*2 and 20*c*2 of the bottom member 20A are also folded back.

Figure 5:
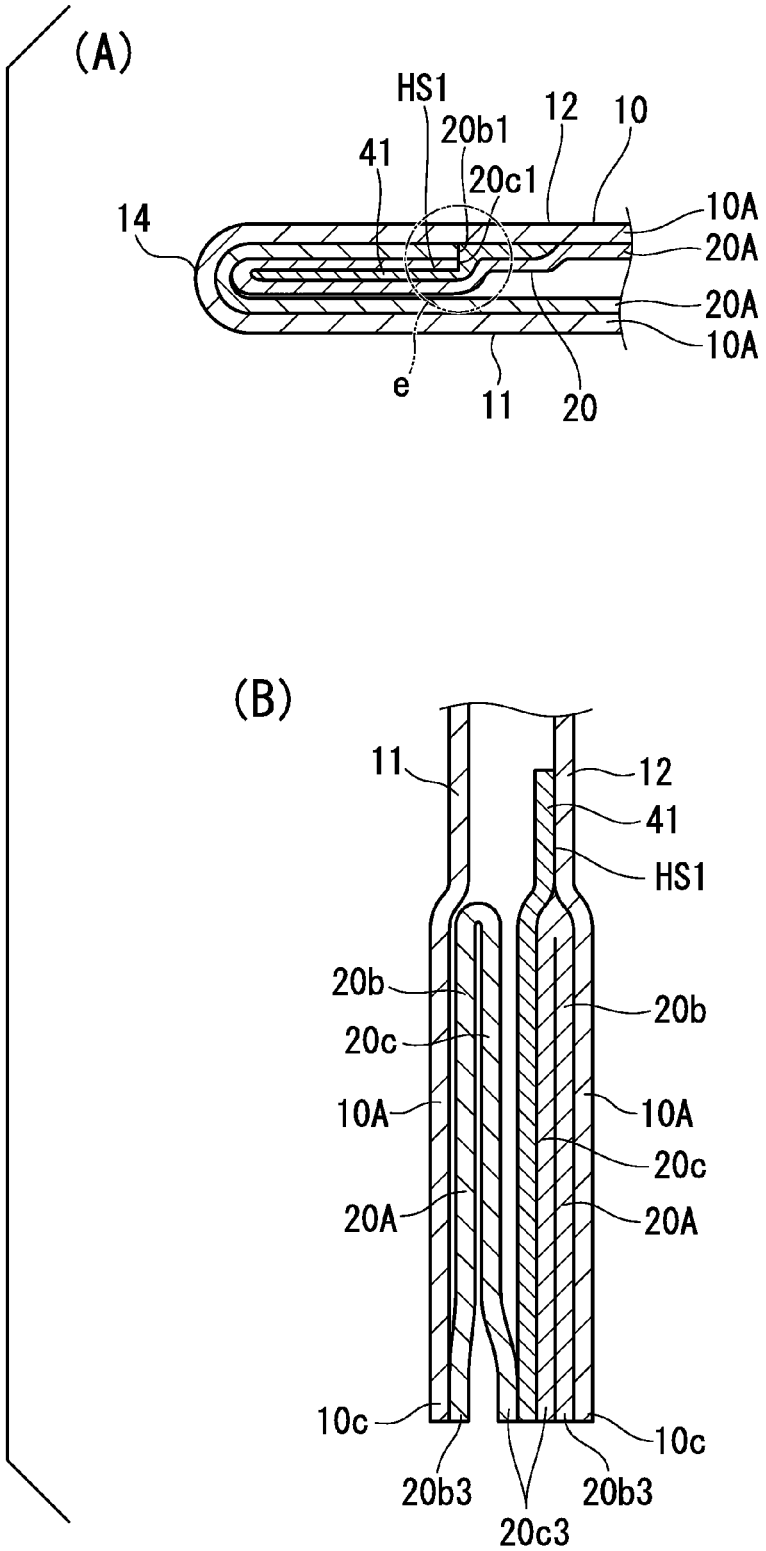
FIG. 5A is a cross-sectional view cut along a line I-I in the self-standing bag of FIG. 2.
FIG. 5B is a cross-sectional view cut along a line II-II in the self-standing bag of FIG. 2.

In the self-standing bag 1, as shown in FIGS. 1, 2 and 5A, the side edges 20*b*1 and 20*c*1 of the bottom member 20A are attached to the back surface portion 12. Due to this, in comparison with the configuration in which the side edges 20*b*1 and 20*c*1 match the edge 14 of the barrel portion 10, it is difficult for fractures to occur at a section of the side edges 20*b*1 and 20*c*1 and the effect which suppresses the leakage of content is high. Similarly, since the side edges 20*b*2 and 20*c*2 are attached to the back surface portion 12 in the self-standing bag 1, it is difficult for fractures to occur at a section of the side edges 20*b*2 and 20*c*2 and the effect which suppresses the leakage of content is high.

Figure 7:
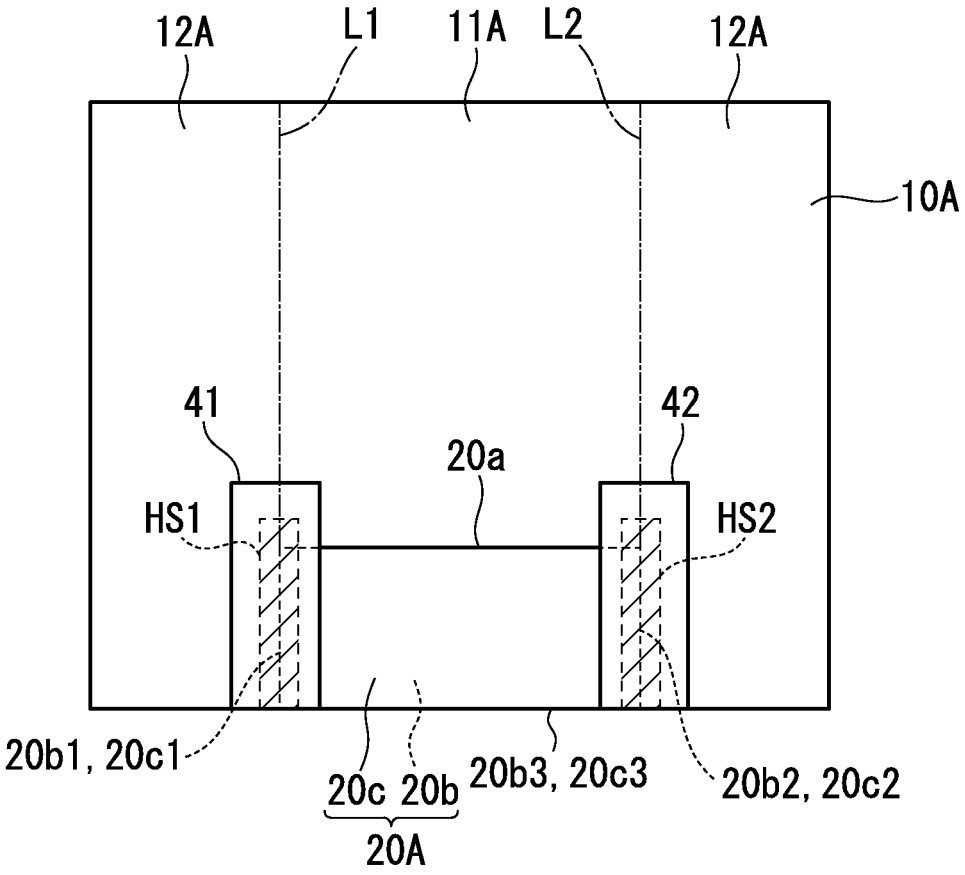
FIG. 7 is a plan view showing an example of a process of producing a self-standing bag other than the self-standing bag of the present invention which has the same shape as the self-standing bag of the present invention.

In the self-standing bag having the barrel portion and the bottom portion, the load of content is easily concentrated on a section where the bottom member and the barrel member are overlapped, particularly, upper ends of the bottom member inside of the edges in the barrel portion. For example, as shown in FIG. 7, in the self-standing bag which has a configuration that the side edges 20*b*1 and 20*c*1 of the bottom member 20A match to the folding line L1 of the barrel member 10A and the side edges 20*b*2 and 20*c*2 match to the folding line L2 of the barrel member 10A, the side edges of the bottom member 20A matches edges of the barrel portion. For this reason, the side edges of the bottom member are located in a section where the load is easily concentrated. Therefore, particularly, fractures occur at the upper sections of the side edges in the bottom portion and the content may leak out.

On the other hand, as shown in FIGS. 1 and 2, the side edge areas of the bottom member 20A are folded back along the edges 14 and 15 of the barrel portion 10, and the side edges 20*b*1 and 20*c*1 and the side edges 20*b*2 and 20*c*2 are attached to the back surface portion 12 in the self-standing bag 1. That is, the side edge sections of the bottom member 20A are adhered not to the edges 14 and 15 of the barrel portion 10 but to the back surface portion 12 which is a plane section of the barrel portion 10. Due to this, in the self-standing bag 1, the side edges of the bottom member are not located at the section in which the bottom member and the barrel member are overlapped each other, and the load is easily concentrated when the content is accommodated, inside of the edges in the barrel portion. Accordingly, the side edges of the bottom member are not located in the section in which the load is easily concentrated, and the load is received in a section in which the bottom member 20A is folded. For this reason, a large force is not concentrated and applied to the side edges of the bottom member 20A, and an effect suppressing the leakage of content due to the occurrence of fractures at the side edges of the bottom member 20A is high.

Figure 8:
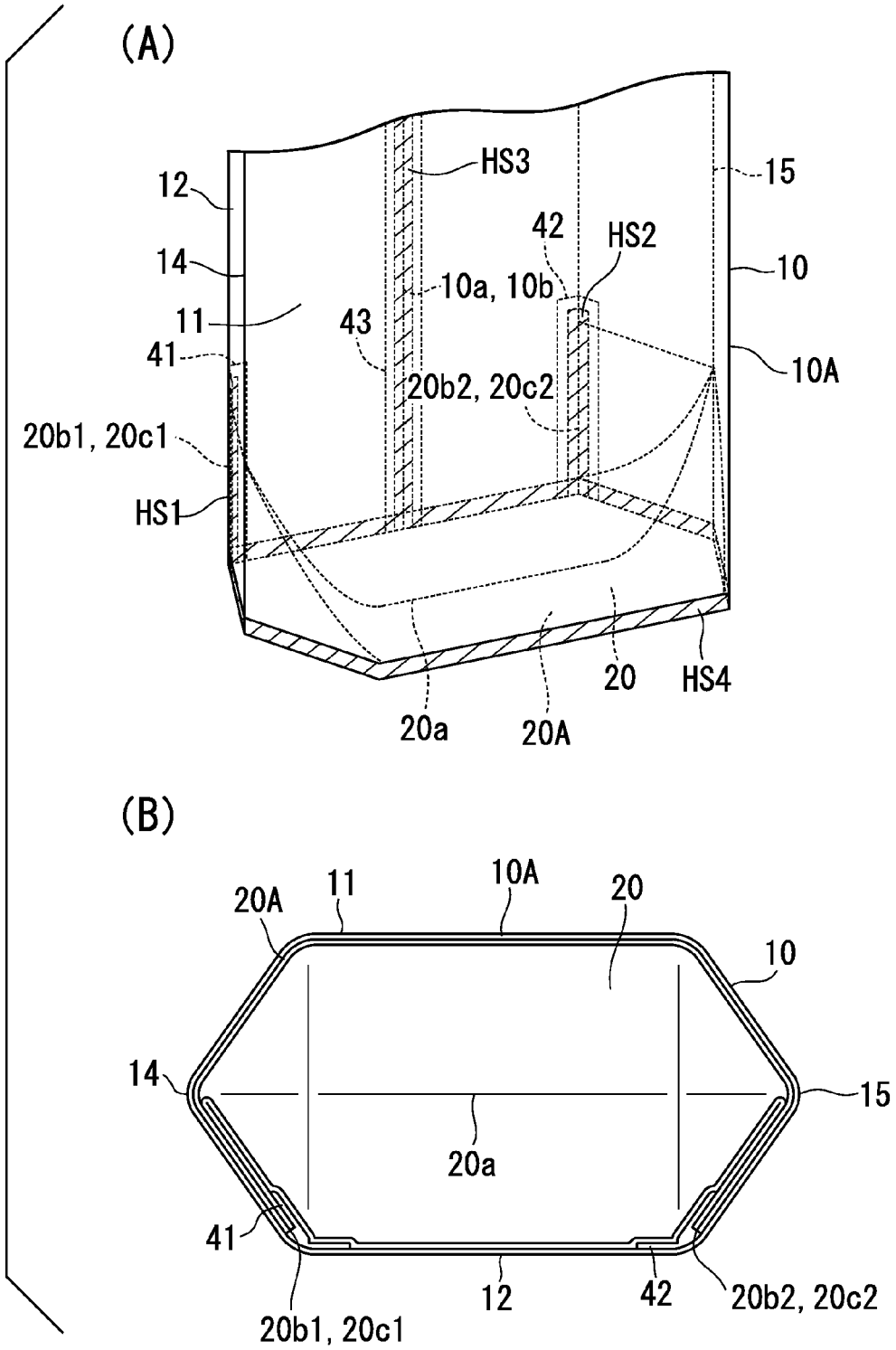
FIG. 8A is a perspective view partially showing a self-standing bag having content therein according to another embodiment of the present invention.
FIG. 8B is a bottom view of the self-standing bag accommodating content therein according to another embodiment of the present invention.

A distance between the side edges 20*b*1 and 20*c*1 which are the side edge areas of the bottom member 20A and the edge 14 of the barrel portion 10, that is, a distance $D_3$ between the side edges 20*b*1 and 20*c*1 of the bottom member 20A and the folding line L1 of the barrel member 10A shown in FIG. 3B is preferably greater than or equal to 1.0 mm, more preferably greater than or equal to 3.0 mm. When the distance $D_3$ is greater than or equal to 1.0 mm, a section of the edges 20*b*1 and 20*c*1 of the bottom member 20A is fractured and the leakage of content is easily suppressed. When the distance $D_3$ is a certain length, in case the content is filled into the self-standing bag, a location which matches the location of the edges 20*b*1 and 20*c*1 of the bottom member 20A in the barrel member 10A is a folding line as shown in FIG. 8A, and the barrel member 10A is easily bent. As a result, when a self-standing bag is seen from the bottom, a self-standing bag of an approximately hexagonal shape is formed as shown in FIG. 8B. The self-standing bag of an approximately hexagonal shape is easily formed when a laminated body having rigidity such as a laminated body which has metal such as aluminum foil as a film which forms the barrel member and the bottom member. In addition, when the self-standing bag is an approximately hexagonal shape, a certain length of the distance $D_3$ depends on the size of the self-standing bag, but when the distance $D_3$ is greater than or equal to 10 mm at least, the self-standing bag of an approximately hexagonal shape is easily formed.

The distance between the side edges 20*b*2 and 20*c*2 of the bottom member 20A and the edge 15 of the barrel portion 10, that is, a distance $D_4$ between the side edges 20*b*2 and 20*c*2 of the bottom member 20A and the folding line L2 of the barrel member 10A is the same as the distance $D_3$.

The distance $D_3$ and the distance $D_4$ may have the same or different length, but it is preferable that the distance $D_3$ and the distance $D_4$ have the same length in teams of the bag having a better appearance.

Attaching the side edges 20*b*1 and 20*c*1 of the bottom member 20A to the inner surface of the back surface portion 12 is performed by using the adhesive member 41 as described above. In the embodiment, as shown in FIGS. 1 and 2, the adhesive member 41 having heat-sealing properties in both surfaces is arranged so as to cover the side edges 20*b*1 and 20*c*1 of the bottom member 20A, and is heat-sealed at the heat-sealed portion HS1 including the side edges 20*b*1 and 20*c*1. In the heat-sealed portion HS1, the adhesive member 41 is adhered to the side edge 20*c*1 of the bottom member 20A, and the adhesive member 41 is adhered to the back surface portion 12. Therefore, the side edges 20*b*1 and 20*c*1 of the bottom member 20A are closed by the adhesive member 41, and attached to the inner surface of the back surface portion 12. That is, as shown in FIG. 3B, the bottom member 20A folded in half is arranged on the barrel member 10A, and the adhesive member 41 is arranged on the bottom member 20A so as to cover the side edges 20*b*1 and 20*c*1. Then, by heat-sealing the adhesive member 41 at the heat-sealed portion HS1 so as to include the side edges 20*b*1 and 20*c*1, the side edges 20*b*1 and 20*c*1 are attached to the section 12A of the barrel member 10A, that is, the back surface portion 12 of the barrel portion 10.

In the heat-sealed portion HS1 in the embodiment, the outer surface of the side edge 20*b*1 in the bottom member 20A and the inner surface of the back surface portion 12 are adhered since the sealant layers thereof face each other. On the other hand, the inner surfaces of the side edges 20*b*1 and 20*c*1 in the bottom member 20A are not adhered since the basic material layers thereof face each other.

Similarly, attaching the side edges 20*b*2 and 20*c*2 of the bottom member 20A to the inner surface of the back surface portion 12 is performed by using the adhesive member 42 as described above. In the embodiment, the adhesive member 42 having heat-sealing properties in both surfaces is arranged so as to cover the side edges 20*b*2 and 20*c*2 of the bottom member 20A, and is heat-sealed at the heat-sealed portion HS2 including the side edges 20*b*2 and 20*c*2. In the heat-sealed portion HS2, the adhesive member 42 is adhered to the side edge 20*c*2 of the bottom member 20A, and the adhesive member 42 is adhered to the back surface portion 12. Therefore, the side edges 20*b*2 and 20*c*2 of the bottom member 20A are closed by the adhesive member 42, and attached to the inner surface of the back surface portion 12. That is, as shown in FIG. 3B, the bottom member 20A folded in half is arranged on the barrel member 10A, and the adhesive member 42 is arranged on the bottom member 20A so as to cover the side edges 20*b*2 and 20*c*2. Then, by heat-sealing the adhesive member 42 at the heat-sealed portion HS2 so as to include the side edges 20*b*2 and 20*c*2, the side edges 20*b*2 and 20*c*2 are attached to the section 12A of the barrel member 10A, that is, the back surface portion 12 of the barrel portion 10.

In the heat-sealed portion HS2 in the embodiment, the outer surface of the side edge 20*b*2 in the bottom member 20A and the inner surface of the back surface portion 12 are adhered since the sealant layers thereof face each other. On the other hand, the inner surfaces of the side edges 20*b*2 and 20*c*2 in the bottom member 20A are not adhered since the basic material layers thereof face each other.

In the self-standing bag 1, a section adhered to the adhesive member 41 is preferably only the back surface portion 12 to which the side edges 20*b*1 and 20*c*1 of the bottom member 20A are attached in the barrel portion 10. In other words, it is preferable that the heat-sealed portion HS1 does not contact the front surface portion 11.

Figure 9:
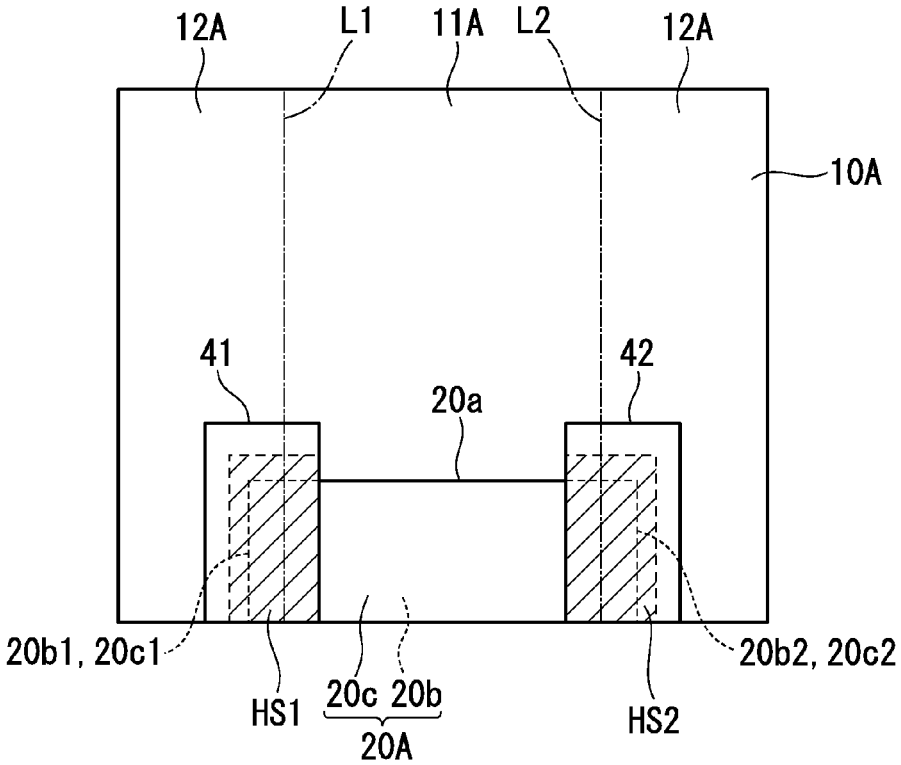
FIG. 9 is a plan view showing an example of a process in producing a self-standing bag other than the self-standing bag of the present invention.

As shown in FIG. 9, the adhesive member 41 is provided so as to contact the section 11A of the barrel member 10A, and a folding line 20*a* of the bottom member 20A is fixed to the section 11A of the barrel member 10A when the heat-sealed portion HS1 contacts the section 11A. That is, when the heat-sealed portion HS1 comes to the front surface portion 11, the folding line 20*a* of the bottom member 20A is fixed to the front surface portion 11. In this way, when the folding line 20*a* is fixed to the front surface portion 11, an upper portion of the bottom member 20A is not spread in the vicinity of the edge 14. Therefore, there is concern that the vicinity of the edge 14 in the barrel portion 10 is hardly spread and the appearance may be deteriorated.

On the other hand, the side edge 41*a* of the folding line L1 of the barrel member 10A in the adhesive member 41 matches the folding line L1 in the self-standing bag 1 as shown in FIG. 3B. Therefore, the side edge 41*a* matches the edge 14 of the barrel portion 10. Further, the side edge 41*a* of the adhesive member 41 may come to the section 11A of the barrel member 10A. Then, since the side edge of the folding line L1 of the heat-sealed portion HS1 also matches the folding line L1, the side edge matches the edge 14, and the heat-sealed portion HS1 does not come to the front surface portion 11. Due to this, the folding line 20*a* of the bottom member 20A is not fixed to the section 11A of the barrel member 10A, and the self-standing bag 1 spreads to a region a in the vicinity of the edge 14 of the barrel portion 10 in the bottom portion 20 as shown in FIG. 1. Therefore, it is suppressed that the vicinity of the edge 14 of the barrel portion 10 is locally narrowed, and independent stability is improved to obtain a better appearance. It is preferable that the side edge 41*a* of the folding line L1 of the barrel member 10A in the adhesive member 41 match the folding line L1 like the side edge of the heat-sealed portion HS1. However, the side edge 41*a* of the folding line L1 of the barrel member 10A may protrude from the folding line L1 on the front surface portion 11 of the barrel portion 10.

When the section where the adhesive member 41 is arranged and the shape of the heat-sealed portion HS1 falls in a range that independent stability and designability are not significantly deteriorated, the adhesive member 41 is arranged so that the adhesive member 41 comes to the front surface portion 11 illustrated in FIG. 9, and the heat-sealed portion HS1 may come to the front surface portion 11.

Similarly, in the self-standing bag 1, a section that is adhered to the adhesive member 42 in the barrel portion 10 is preferably only the back surface portion 12 where the side edges 20*b*2 and 20*c*2 of the bottom member 20A are attached. In other words, the adhesive member 42 is provided so as not to contact the front surface portion 11, and the heat-sealed portion HS2 does not preferably contact the front surface portion 11.

The side edge 42*a* of the folding line L2 of the barrel member 10A in the adhesive member 42 matches the folding line L2 in the self-standing bag 1, as shown in FIG. 3B. Therefore, the side edge 42*a* matches the edge 15 of the barrel portion 10. Further, the side edge 42*a* of the adhesive member 42 may come to the section 11A of the barrel member 10A. Since the edge of the folding line L2 of the heat-sealed portion HS2 also matches the folding line L2, the side edge matches the edge 15, and the heat-sealed portion HS2 does not come to the front surface portion 11. Therefore, the folding line 20*a* of the bottom member 20A is not fixed to the section 11A of the barrel member 10A, and the self-standing bag 1 spreads to a region b in the vicinity of the edge 15 of the barrel portion 10 in the bottom portion 20, as shown in FIG. 1. Therefore, it is suppressed that the vicinity of the edge 15 of the barrel portion 10 is locally narrowed, and independent stability is improved to obtain better appearance. It is preferable that the side edge 42*a* of the folding line L2 of the barrel member 10A in the adhesive member 42 match the folding line L2 like side edge of the heat-sealed portion HS2. However, the side edge 42*a* of the folding line L2 of the barrel member 10A may protrude from the folding line L2 on the front surface portion 11 of the barrel portion 10.

When the section where the adhesive member 42 is arranged and the shape of the heat-sealed portion HS2 falls in a range that independent stability and designability are not deteriorated too much, the adhesive member 42 is arranged so that the adhesive member 42 comes to the front surface portion 11 illustrated in FIG. 9, and the heat-sealed portion HS2 may come to the front surface portion 11.

Figure 10:
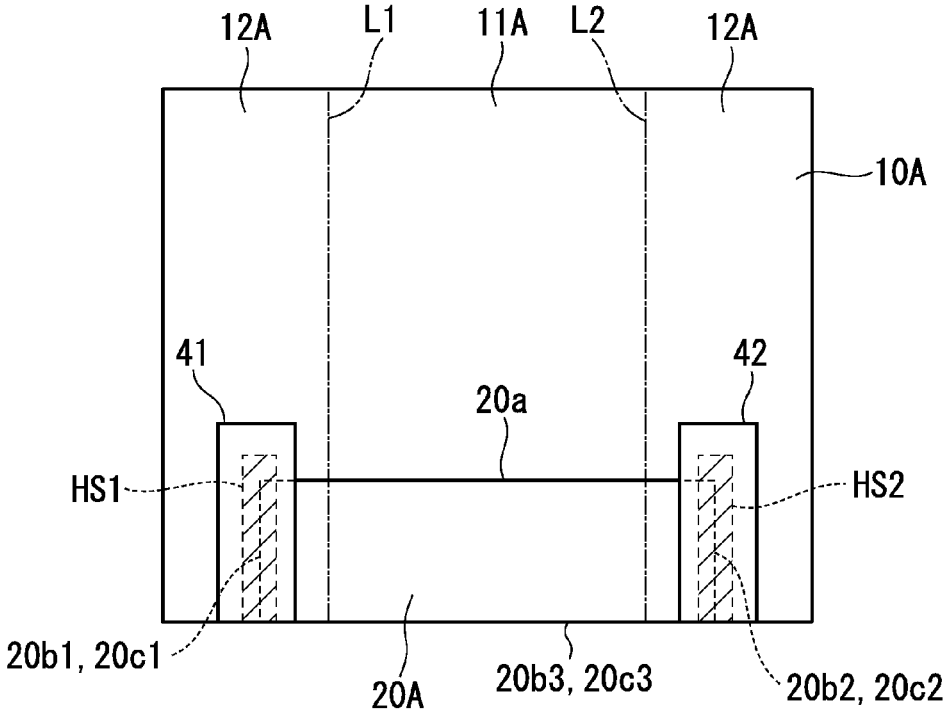
FIG. 10 is a plan view showing a process in a production method of a self-standing bag according to another embodiment of the present invention.

On the other hand, as shown in FIG. 10, the heat-sealed portion HS1 may not come to the folding line L1. The folding line 20*a* of the bottom member 20A is not fixed to the vicinity of the folding line L1 in this case.

Therefore, the bottom portion 20 is only fixed to the lower end in the edge 14 of the barrel portion 10 in the self-standing bag 1. However, in the embodiment, the self-standing bag 1 spreads to the region a in the vicinity of the edge 14 of the barrel portion 10 in the bottom portion 20. Therefore, it is suppressed that the vicinity of the edge 14 of the barrel portion 10 is locally narrowed, and independent stability is improved to obtain a good appearance. Similarly, the heat-sealed portion HS2 may not come to the folding line L2. In the embodiment, the self-standing bag 1 spreads to the region b in the vicinity of the edge 15 of the barrel portion 10 in the bottom portion 20. Therefore, it is suppressed that the vicinity of the edge 15 of the barrel portion 10 is locally narrowed, and independent stability is improved to obtain a good appearance.

In each embodiment described above, as shown in FIGS. 20A to 20C described below, when the form of the heat-sealed portion HS4 is changed, the barrel portion 10 and the bottom portion 20 are fixed to the edge 14 of the barrel portion 10, thereby improving independent stability.

Figure 6:
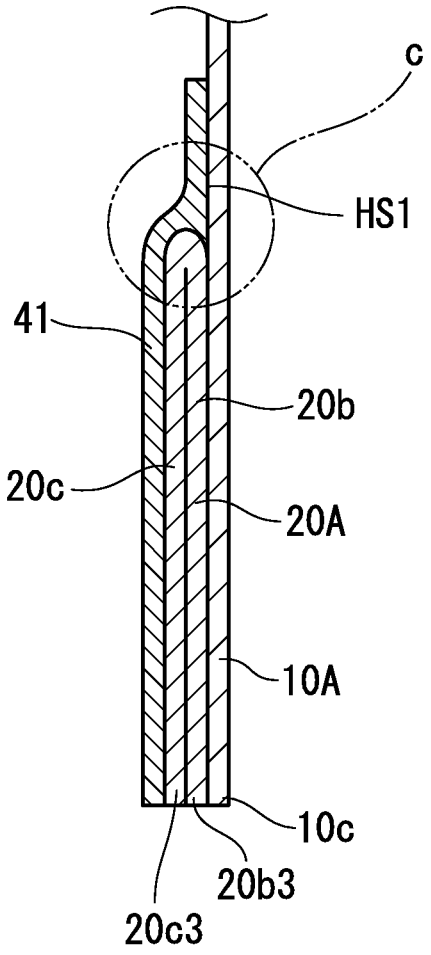
FIG. 6 is a cross-sectional view of a laminated body of each member in FIG. 3B cut along a line III-III.

A step difference is generated at a boundary between the section formed by overlapping the bottom member 20A and the barrel member 10A and the section formed with only the barrel member 10A in a region c around the upper ends of the side edges 20*b*1 and 20*c*1 in the bottom member 20A, of the section where the adhesive member 41 is arranged, at the section which is heat-sealed at the heat-sealed portion HS1 and where the side edges 20*b*1 and 20*c*1 of the bottom member 20A are attached to the section 12A of the barrel member 10A, that is, the back surface portion 12 of the barrel portion 10, as shown in FIGS. 3B and 6. Specifically, as shown in FIG. 6, a step difference is generated between the section where the adhesive member 41, two bottom members 20A and one barrel member 10A are overlapped and the section where the adhesive member 41 and one barrel member 10A are overlapped in the region c. Then, adhesive defects are generated due to this step difference in some cases. Therefore, it is preferable for the step difference section to perform point sealing as well as heat-sealing of the heat-sealed portion HS1 in the region c to increase the effect which suppresses adhesive defects.

In the same manner, as shown in FIG. 3B, it is preferable to perform point sealing on the step difference section in a region d around the upper ends of the side edges 20*b*2 and 20*c*2 in the bottom member 20A.

A step difference also is generated in the section along the side edges 20*b*1 and 20*c*1 of the bottom member 20A and the section along the side edges 20*b*2 and 20*c*2. Therefore, it is preferable to perform point sealing in the step difference section.

As shown in FIGS. 1 and 2, the lower ends 20*b*3 and 20*c*3 of the bottom member 20A and the lower end 10*c* of the barrel portion 10 are heat-sealed and adhered at the heat-sealed portion HS4 over the entire circumference of the barrel portion 10.

As shown in FIG. 5A, in a region e of the edge 14 of the barrel portion 10 at the heat-sealed portion HS4, a step difference is generated between the section formed by overlapping the bottom member 20A and the barrel member 10A and the section formed by overlapping the bottom member 20A, the barrel member 10A and the side edge areas of the bottom member 20A. Therefore, it is preferable for the step difference section to perform point sealing as well as the heat-sealed portion HS4 to increase the effect which suppresses adhesive defects. Similarly, a step difference is generated at the edge 15 of the barrel portion 10. Therefore, it is preferable for the step difference section to perform point sealing as well as the heat-sealed portion HS4.

The upper portion of the barrel portion 10 is heat-sealed at the heat-sealed portion HS5 in a state in which the spout 30 is inserted between the front surface portion 11 and the back surface portion 12. Therefore, the barrel portion 10 is sealed in a state in which the spout 30 is liquid-tightly attached.

As the spout 30, a known spout can be used.

The spout 30 of the embodiment has a pouring pipe 31 which is inserted into the barrel portion 10 and pours out the content, and a cap 32 which is screwed to an upper section of the pouring pipe 31 and seals the spout of the pouring pipe 31.

A section which is adhered to at least the inner surface of the barrel portion 10 in the pouring pipe 31 of the spout 30 is preferably formed with synthetic resin.

As the synthetic resin forming the section which is adhered to at least the inner surface of the barrel portion 10 in the pouring pipe 31 of the spout 30, polyolefin resin, polyamide resin, polyester resin, (meth)acrylic resin, vinyl chloride resin, vinylidene chloride resin and polyether sulfone and ethylene-vinylalcohol copolymers can be mentioned. In particular, polyolefin resin is preferable in the point of excellent workability and low costs.

As polyolefin resin, for example, polyethylene based resin such as high-density polyethylene, medium-density polyethylene, low-density polyethylene, linear low-density polyethylene, and ethylene-vinyl acetate copolymers, olefin based elastomers such as ethylene-α-olefin copolymers, polypropylene based resin such as polypropylene, ethylene-propylene random copolymers, α-olefin-propylene random copolymers, and cyclic polyolefin resin can be mentioned. These resins may be blended for performance improvement, and the resins may be partially cross-linked for the purpose of improving heat resistance.

The spout 30 may be formed with a single material or a multi-layered structure made up of various resin layers.

Resin forming the section which is adhered to at least the inner surface of the barrel portion 10 in the pouring pipe 31 of the spout 30 is preferably the same resin as the sealant layer in the inner surfaces of the front surface portion 11 and the back surface portion 12 from the point of adhesive properties.

In the above-described self-standing bag 1, the side edges 20*b*1 and 20*c*1 and the side edges 20*b*2 and 20*c*2 of the bottom member 20A are each folded back along the edges 14 and 15 of the barrel portion 10. Therefore, the side edges 20*b*1 and 20*c*1 and the side edges 20*b*2 and 20*c*2 of the bottom member 20A are attached to the inner surface of the back surface portion 12.

Due to this, since the heat-sealed portion in which the inner surfaces of the front surface portion 11 and the back surface portion 12 are adhered is not formed in the edges 14 and 15 of the barrel portion 10, the barrel portion 10 can be grasped without an uncomfortable feeling and obtain a good appearance. In addition, the side edges 20*b*1 and 20*c*1 and the side edges 20*b*2 and 20*c*2 of the bottom member 20A are attached to the back surface portion 12 so that a load at the time of accommodating content is not concentrated on the side edges. Thus, a leakage of content by fractures at the side edges of the bottom member 20A can be suppressed.

(Production Method)

Hereinafter, an example according to an embodiment of a production method of a self-standing bag in the present invention is shown. The production method of a self-standing bag according to the embodiment includes following processes (I) to (V).

(I) Arranging a film-like bottom member where a folding line is set as an upper end and which is folded in half or a film-like bottom member of which lower ends are opened and formed in a flattened pouch shape on a film-like barrel member so that a lower end of the barrel member matches lower ends of the bottom member.

(II) Arranging an adhesive member which adheres the barrel member and the bottom member so as to cover the side edges of the bottom member arranged on the barrel member.

(III) Adhering side edges of the bottom member and the barrel member, and the adhesive member to attach the side edges of the bottom member to the barrel member.

(IV) Forming a barrel portion by folding back respective side edge areas of the barrel member with the side edge areas of the bottom member and adhering the side edges of the barrel member each other such that a surface where the bottom member is adhered forms an inner surface and the folding lines are formed in a center from both side edges of the bottom member.

(V) Forming a bottom portion by adhering the lower ends of the bottom member and the lower end of the barrel portion over the entire circumference of the barrel portion.

Furthermore, the production method of self-standing bag according to the embodiment preferably includes the following process (VI).

(VI) Performing point sealing on a step difference section at a boundary between a section formed by overlapping the bottom member with the barrel member and a section formed with only the barrel member in upper ends of the side edge areas in the bottom member after the processes (II) and (III).

As an example of the production method of a self-standing bag according to the embodiment, the production method of a self-standing bag 1 will be described when a laminated film in which a sealant layer and a basic material layer are laminated is used as the barrel member 10A and the bottom member 20A.

Process (I)

As shown in FIG. 3A, the bottom member 20A is folded in half so that the sealant layer forms an outside.

At this time, the folding line is set as the upper end in the bottom member 20A folded in half, the side edge 20*b*1 of the first bottom surface portion 20*b* matches the side edge 20*c*1 of the second bottom surface portion 20*c*, the side edge 20*b*2 of the first bottom surface portion 20*b* matches the side edge 20*c*2 of the second bottom surface portion 20*c*, and the lower end 20*b*3 of the first bottom surface portion 20*b* matches the lower end 20*c*3 of the second bottom surface portion 20*c*.

Then, as shown in FIG. 3B, the barrel member 10A is arranged to form on the sealant layer, and the bottom member 20A folded in half is arranged so that the lower end 10*c* of the barrel member 10A matches the lower ends 20*b*3 and 20*c*3 of the bottom member 20A on the barrel member 10A. At this time, the sealant layer of the first bottom surface portion 20*b* in the bottom member 20A and the sealant layer of the barrel member 10A face each other. In addition, the bottom member 20A is arranged such that the side edges 20*b*1 and 20*c*1 of the bottom member 20A are located in the section 12A of the side edge 10*a* from the folding line L1 which folds back the barrel member 10A. In the same manner, the bottom member 20A is arranged such that the side edges 20*b*2 and 20*c*2 of the bottom member 20A are located in the section 12A of the side edge 10*b* from the folding line L2 which folds back the barrel member 10A.

Process (II)

As shown in FIG. 3B, the adhesive member 41 is arranged on the side edges 20*b*1 and 20*c*1 of the bottom member 20A arranged on the barrel member 10A so as to cover the side edges 20*b*1 and 20*c*1. Moreover, the adhesive member 42 is arranged on the side edges 20*b*2 and 20*c*2 of the bottom member 20A so as to cover the side edges 20*b*2 and 20*c*2.

Process (III)

As shown in FIG. 3B, heat-sealing is performed at the heat-sealed portion HS1 on the adhesive member 41 so as to cover the side edges 20*b*1 and 20*c*1 of the bottom member 20A. The adhesive member 41 and the side edge 20*c*1 of the bottom member 20A are adhered and the adhesive member 41 and the section 12A of the barrel member 10A are adhered at the heat-sealed portion HS1. Therefore, the side edges 20*b*1 and 20*c*1 of the bottom member 20A is closed by the adhesive member 41, and attached to the section 12A of the barrel member 10A. In addition, at the heat-sealed portion HS1 of the embodiment, the outer surface of the side edge 20*b*1 in the bottom member 20A and the section 12A of the barrel member 10A are adhered by heat-sealing since the sealant layers are in close contact. On the other hand, the inner surfaces of the side edges 20*b*1 and 20*c*1 in the bottom member 20A are not adhered since the basic material layers are in close contact.

Similarly, heat-sealing is performed at the heat-sealed portion HS2 on the adhesive member 42 so as to cover the side edges 20*b*2 and 20*c*2 of the bottom member 20A. The adhesive member 42 and the side edge 20*c*2 of the bottom member 20A are adhered and the adhesive member 42 and the section 12A of the barrel member 10A are adhered at the heat-sealed portion HS2. Therefore, the side edges 20*b*2 and 20*c*2 of the bottom member 20A is closed by the adhesive member 42, and attached to the section 12A of the barrel member 10A. In addition, at the heat-sealed portion HS2 of the embodiment, the outer surface of the side edge 20*b*2 in the bottom member 20A and the section 12A of the barrel member 10A are adhered by heat-sealing since the sealant layers are in close contact. On the other hand, the inner surfaces of the side edges 20*b*2 and 20*c*2 in the bottom member 20A are not adhered since the basic material layers are in close contact.

Process (IV)

The side edges 10*a* and 10*b* of the barrel member 10A are folded back with the side edges of the bottom member 20A along the folding lines L1 and L2 which is located in the center from the side edge area of the bottom member 20A such that a side where the bottom member 20A is adhered forms an inner surface. Furthermore, as shown in FIG. 4A, the adhesive member 43 is overlapped with the side edges 10*a* and 10*b*, and heat-sealed at the heat-sealed portion HS3 to form the back seal 13. Thus, the cylindrical-shaped barrel portion 10 having the front surface portion 11 and the back surface portion 12 is formed.

Process (V)

The lower ends 20*b*3 and 20*c*3 of the bottom member 20A and the lower end 10*c* of the barrel portion 10 are heat-sealed at the heat-sealed portion HS4 over the entire circumference of the barrel portion 10 to form the bottom portion 20. As shown in FIG. 5A, a step difference is generated between the section formed by overlapping the bottom member 20A and the barrel member 10A and the section formed by overlapping the bottom member 20A, the barrel member 10A and the side edge areas of the bottom member 20A in heat-sealing at the heat-sealed portion HS4, in the region e of the edge 14 in the barrel portion 10. Therefore, it is preferable for the step difference section to perform point sealing as well as heat-sealing of the heat-sealed portion HS4 to increase the effect which suppresses adhesive defects. Similarly, a step difference is generated at the edge 15 of the barrel portion 10. Therefore, it is preferable for the step difference section to perform point sealing as well as the heat-sealed portion HS4.

Process (VI)

As shown in FIG. 3B, heat-sealing is intensively performed on the step difference section between the region c around the upper ends of the side edges 20*b*1 and 20*c*1 in the bottom member 20A and the region d around the upper ends of the side edges 20*b*2 and 20*c*2, and point sealing is further performed to increase the effect which suppresses adhesive defects.

Process (VII)

In the upper portion of the barrel portion 10, the pouring pipe 31 in the spout 30 is inserted between the front surface portion 11 and the back surface portion 12. In the state in which the pouring pipe 31 is inserted between the front surface portion 11 and the back surface portion 12, the heat-sealed portion HS5 is heat-sealed as shown in FIG. 2. Furthermore, the spout 30 is liquid-tightly attached to an upper portion of the pouring pipe 31 and the barrel portion 10 is sealed.

As a filling method of content, a filling method from the pouring pipe 31, a filling method before the spout 30 is attached, and a filling method from a section of the heat-sealed portion HS5 which remains not heat-sealed can be mentioned.

The process (VI) in the production method of a self-standing bag 1 may be performed after the process (II) or the process (III), but a method sequentially performing each process described above is not limited. For example, the process (VI) is performed after the process (II), and then the process (III) and following processes may be performed. In addition, the process (VI) is performed after the process (III), and then the process (IV) and following processes may be performed.

The process (VI) may not be performed.

(Other Embodiment)

The self-standing bag of the present invention is not limited to the above-described self-standing bag 1.

Figure 11:
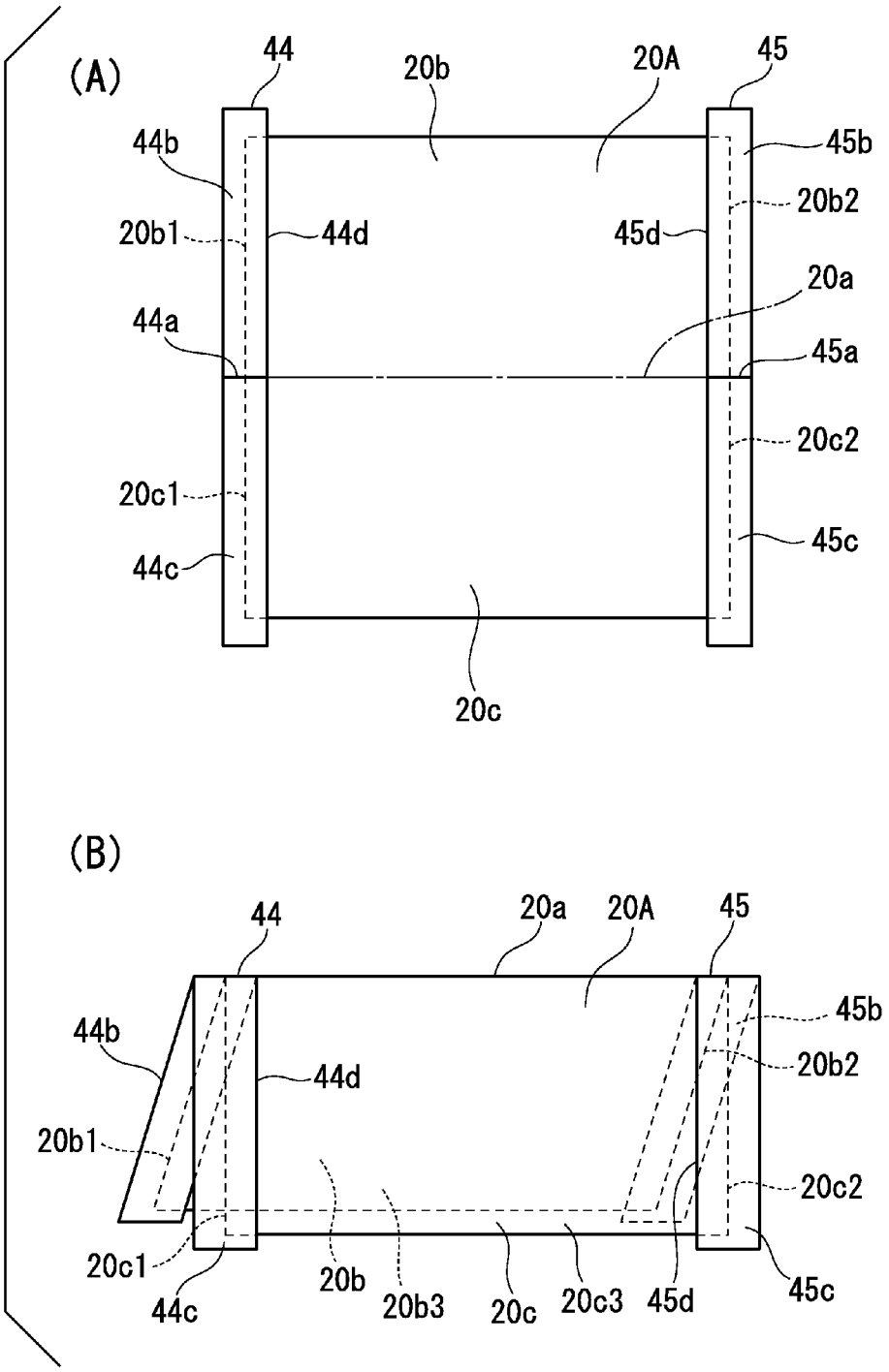
FIG. 11A is a plan view showing a process in the production method of a self-standing bag according to another embodiment of the present invention.
FIG. 11B is a perspective view showing a process in the production method of a self-standing bag according to another embodiment of the present invention.

For example, an adhesive members 44 and 45 illustrated in FIG. 11A may be used instead of the adhesive members 41 and 42. The material of the adhesive members 44 and 45 is the same material given in the adhesive members 41 and 42.

Figure 12:
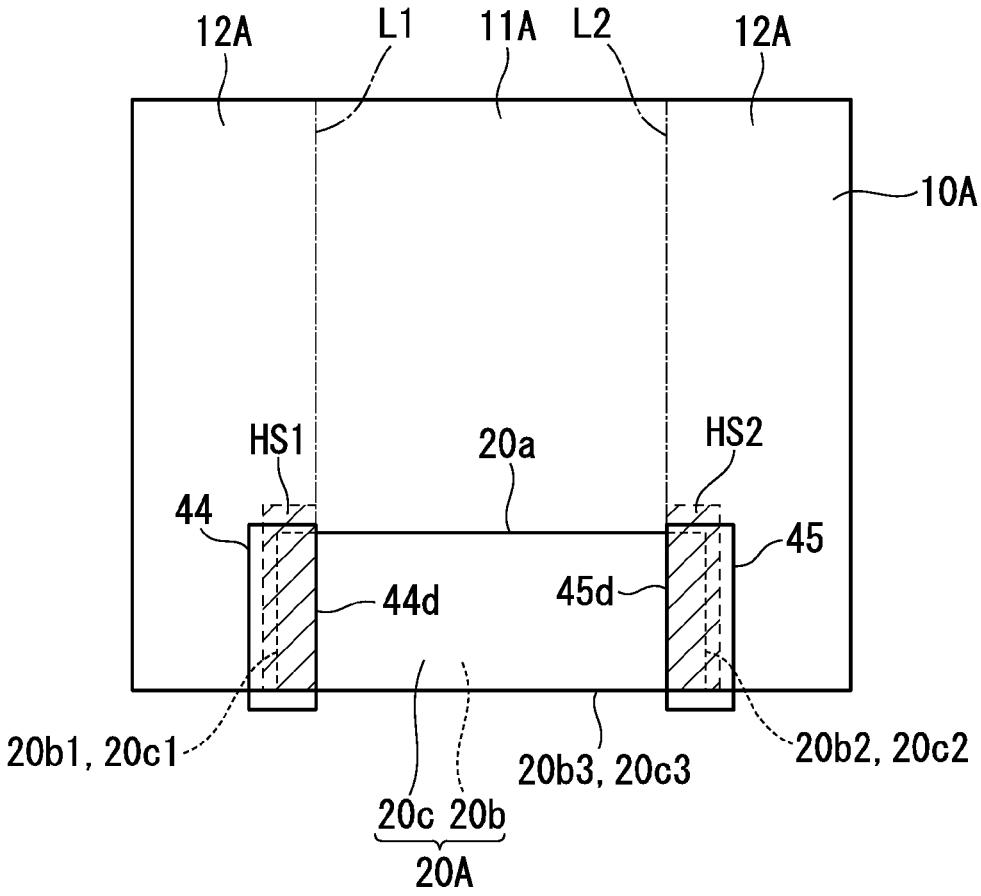
FIG. 12 is a plan view showing a process in the production method of a self-standing bag according to another embodiment of the present invention.

A first bonding portion 44*b* and a second bonding portion 44*c* are partitioned by folding the adhesive member 44 in half along a folding line 44*a*. As shown in FIGS. 11B and 12, the adhesive member 44 is arranged such that the side edges 20*b*1 and 20*c*1 of the bottom member 20A are inserted between the first bonding portion 44*b* and the second bonding portion 44*c*. In the same manner, a first bonding portion 45*b* and a second bonding portion 45*c* are partitioned by folding the adhesive member 45 in half along a folding line 45*a*. Then, the adhesive member 45 is arranged such that the side edges 20*b*2 and 20*c*2 of the bottom member 20A are inserted between the first bonding portion 45*b* and the second bonding portion 45*c*.

As shown in FIG. 12, the side edges 20*b*1 and 20*c*1 and the side edges 20*b*2 and 20*c*2 of the bottom member 20A are closed by the adhesive members 44 and 45, and the bottom member 20A is attached to the section 12A of the barrel member 10A by heat-sealing the adhesive members in the heat-sealed portions HS1 and HS2.

In the embodiment, it is preferable for the heat-sealed portion HS1 not to come to the section 11A of the barrel member 10A, that is, the front surface portion 11 of the barrel portion 10. In addition, it is preferable for the heat-sealed portion HS2 not to come to the section 11A of the barrel member 10A, that is, the front surface portion 11 of the barrel portion 10.

Figure 13:
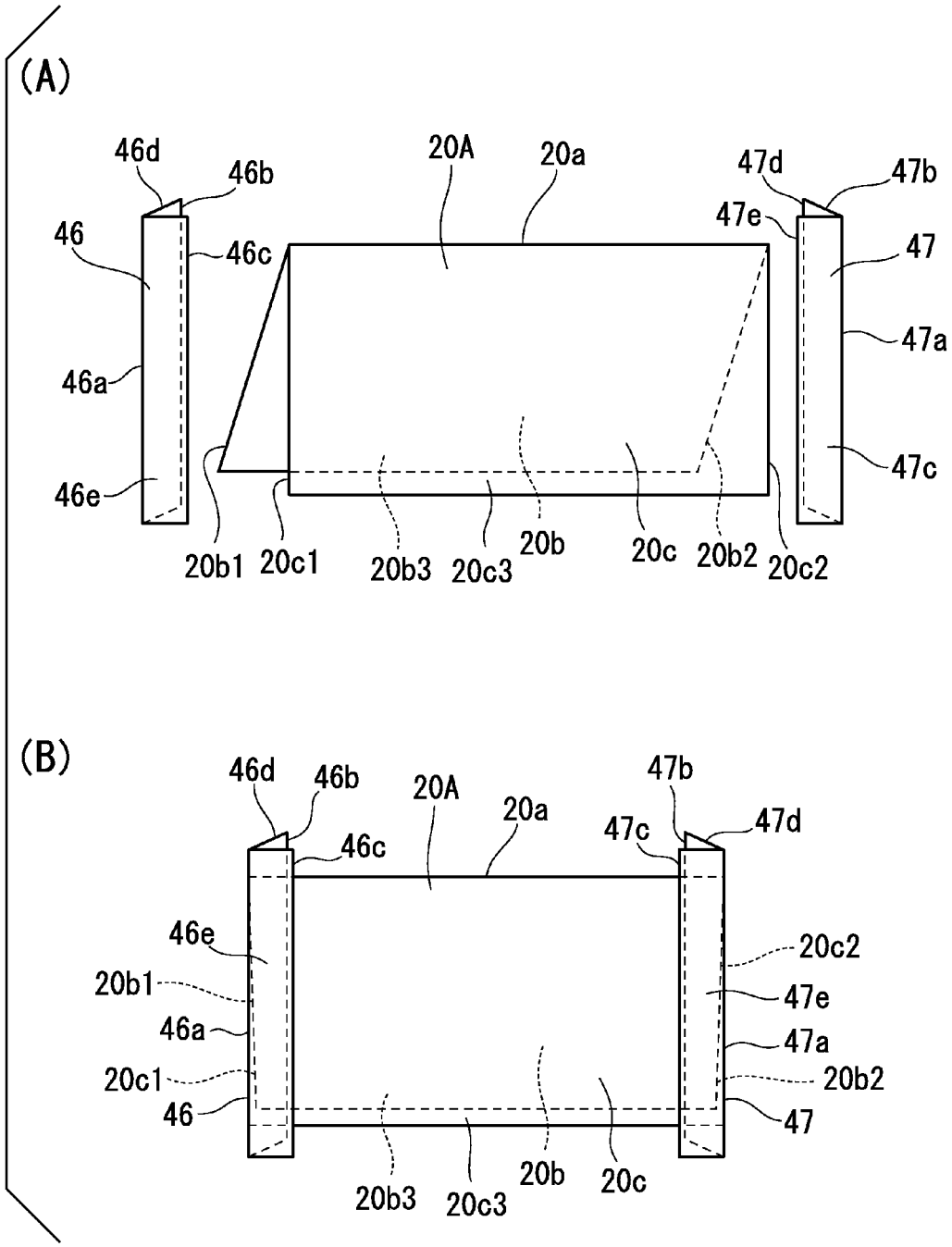
FIG. 13A is a plan view showing a process in the production method of a self-standing bag according to another embodiment of the present invention.
FIG. 13B is a perspective view showing a process in the production method of a self-standing bag according to another embodiment of the present invention.

An adhesive members 46 and 47 illustrated in FIG. 13A may be used instead of the adhesive members 41 and 42. The material of the adhesive members 46 and 47 is the same material exemplified in the adhesive members 41 and 42.

Figure 14:
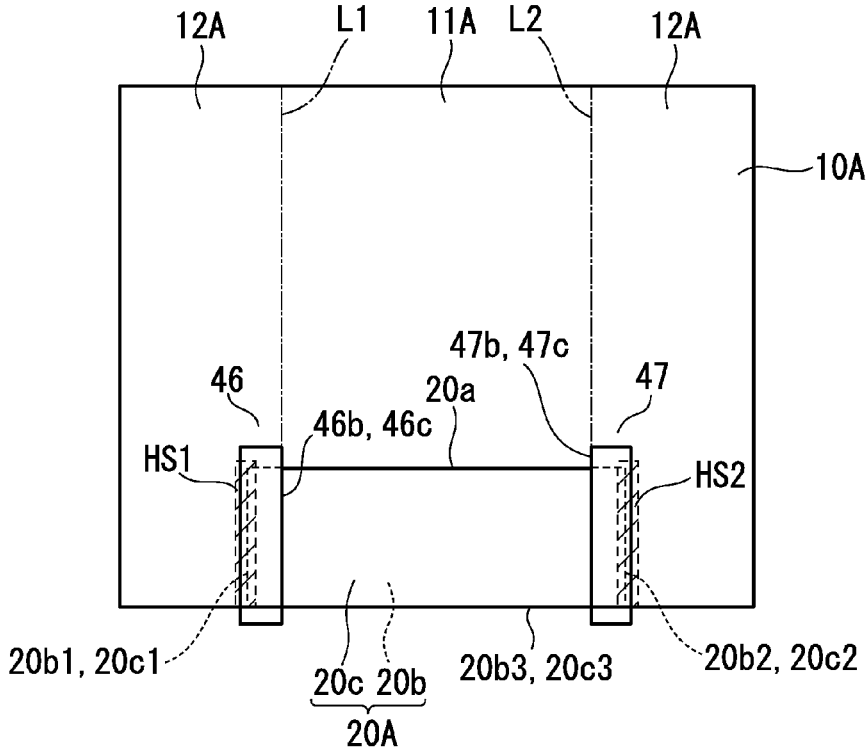
FIG. 14 is a plan view showing a process in the production method of a self-standing bag according to another embodiment of the present invention.

A first bonding portion 46*d* and a second bonding portion 46*e* are partitioned by folding the adhesive member 46 in half along a folding line 46*a* to match side edge 46*b* to side edge 46*c*. As shown in FIGS. 13B and 14, the adhesive member 46 is arranged such that the side edges 20*b*1 and 20*c*1 of the bottom member 20A are inserted between the first bonding portion 46*d* and the second bonding portion 46*e*.

In the same manner, a first bonding portion 47*d* and a second bonding portion 47*e* are partitioned by folding the adhesive member 47 in half along a folding line 47*a* to match side edge 47*b* to side edge 47*c* of the adhesive member 47. The adhesive member 47 is arranged such that the side edges

20*b*2 and 20*c*2 of the bottom member 20A are inserted between the first bonding portion 47*d* and the second bonding portion 47*e*.

As shown in FIG. 14, the side edges 20*b*1 and 20*c*1 and the side edges 20*b*2 and 20*c*2 of the bottom member 20A are closed by the adhesive members 46 and 47, and the bottom member 20A is attached to the section 12A of the barrel member 10A by heat-sealing the in adhesive members the heat-sealed portions HS1 and HS2.

In the embodiment, it is preferable for the heat-sealed portion HS1 not to come to the section 11A of the barrel member 10A, that is, the front surface portion 11 of the barrel portion 10. In addition, it is preferable for the heat-sealed portion HS2 not to come to the section 11A of the barrel member 10A, that is, the front surface portion 11 of the barrel portion 10.

In a self-standing bag of the embodiment using the adhesive members 44 and 45 and a self-standing bag of the embodiment using the adhesive members 46 and 47, the side edges of the bottom member are heat-sealed in a state in which the side edges 20*b*1 and 20*c*1 and side edges 20*b*2 and 20*c*2 of the bottom member 20A are inserted in the adhesive members. Therefore, the effect which suppresses the leakage of content from the side edges of the bottom member 20A is higher in comparison to the self-standing bag 1 described above. However, in the self-standing bag 1, the leakage of content from the side edges 20*b*1 and 20*c*1 and side edges 20*b*2 and 20*c*2 of the bottom member 20A can be sufficiently suppressed.

Figure 15:
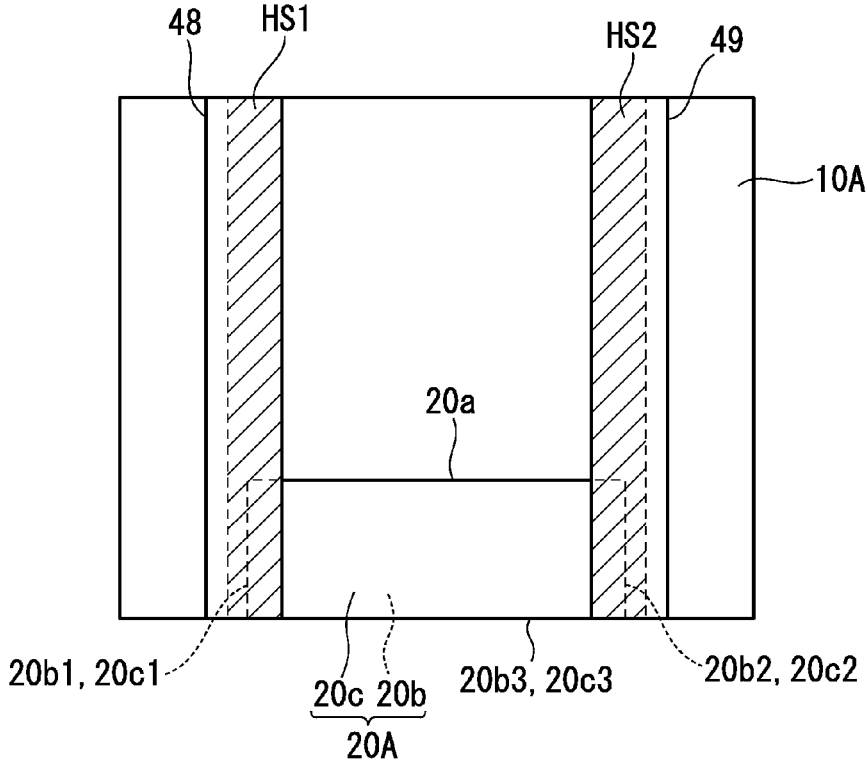
FIG. 15 is a plan view showing a process in the production method of a self-standing bag according to another embodiment of the present invention.

In addition, instead of the adhesive members 41 and 42, an adhesive members 48 and 49 having the length from the upper end to the lower ends of the barrel member 10A may be used to form the heat-sealed portion HS1 and the heat-sealed portion HS2 from the upper end to the lower ends of the barrel member 10A as shown in FIG. 15. The material of the adhesive members 48 and 49 may be the same material given in the adhesive members 41 and 42. When a self-standing bag is successively produced in a longitudinal direction, high productivity is obtained due to successively supplying the barrel member and the adhesive member.

A length of the adhesive member in a vertical direction is the same as the length in the embodiments using the adhesive members 44 and 45 and the adhesive members 46 and 47.

Figure 16:
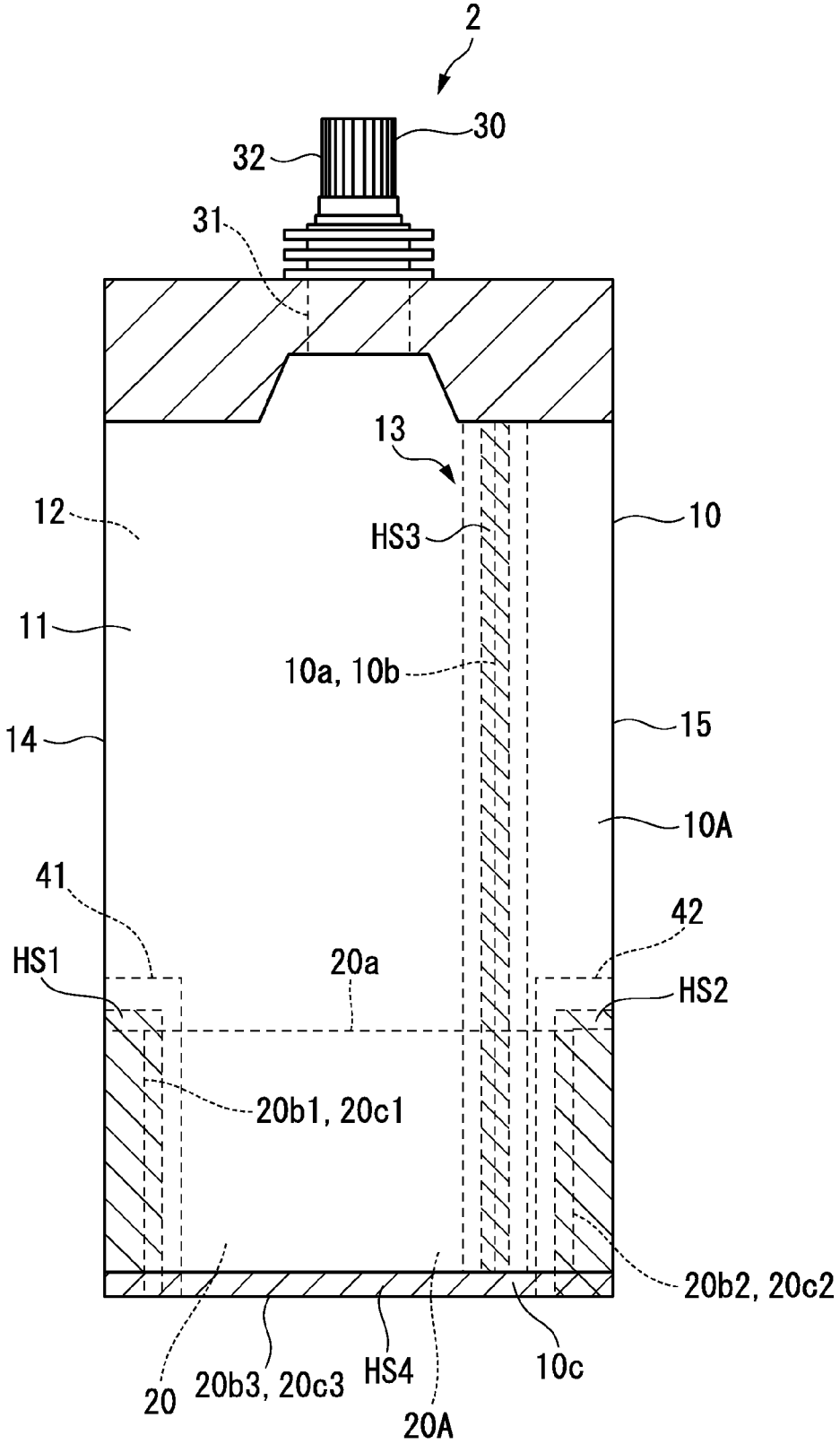
FIG. 16 is a front view showing a flattened state of a self-standing bag according to another embodiment of the present invention.
Figure 17:
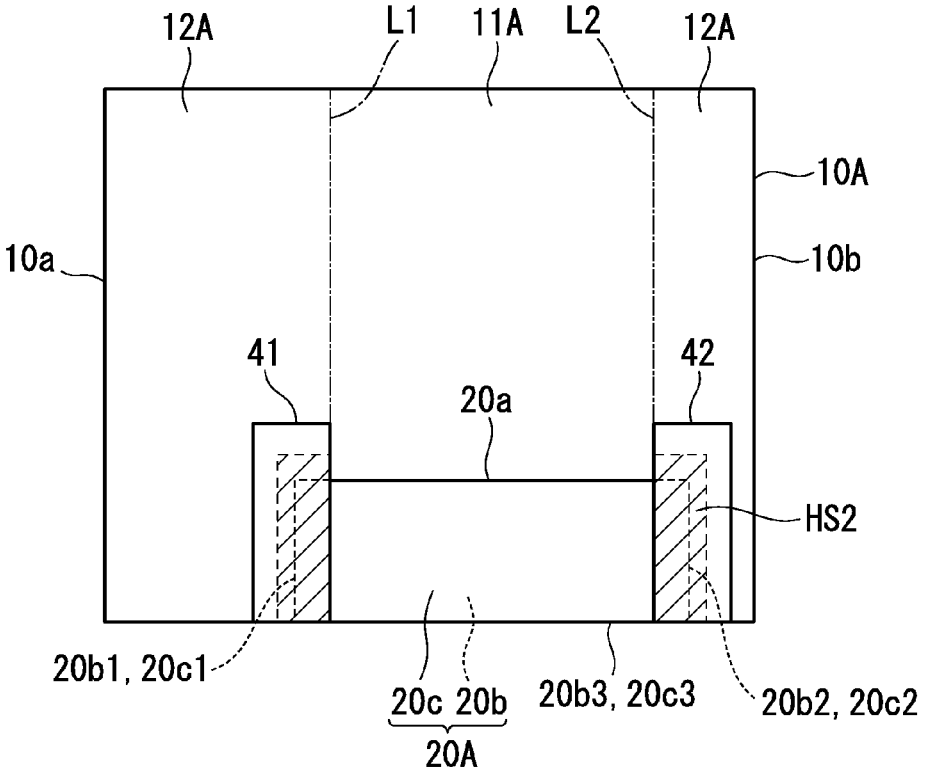
FIG. 17 is a plan view showing a process in the production method of a self-standing bag according to another embodiment of the present invention.

The back seal 13 in the self-standing bag 1 is formed in the center of the back surface portion 12 in the width direction, but the location of the back seal 13 is not limited to the center of the back surface portion 12. For example, as shown in FIG. 16, the back seal 13 in a self-standing bag 2 may be formed in the side edge 15 from the center in the width direction. The self-standing bag 2 may be formed in the same method as the self-standing bag 1 apart from the fact that the folding lines L1 and L2 which fold back the barrel member 10A are formed at the location close to the side edge 10*b* and consequently, the bottom member 20A, and the adhesive members 41 and 42 arranged on the barrel member 10A are formed at the location close to the side edge 10*b*, as shown in FIG. 17.

Figure 18:
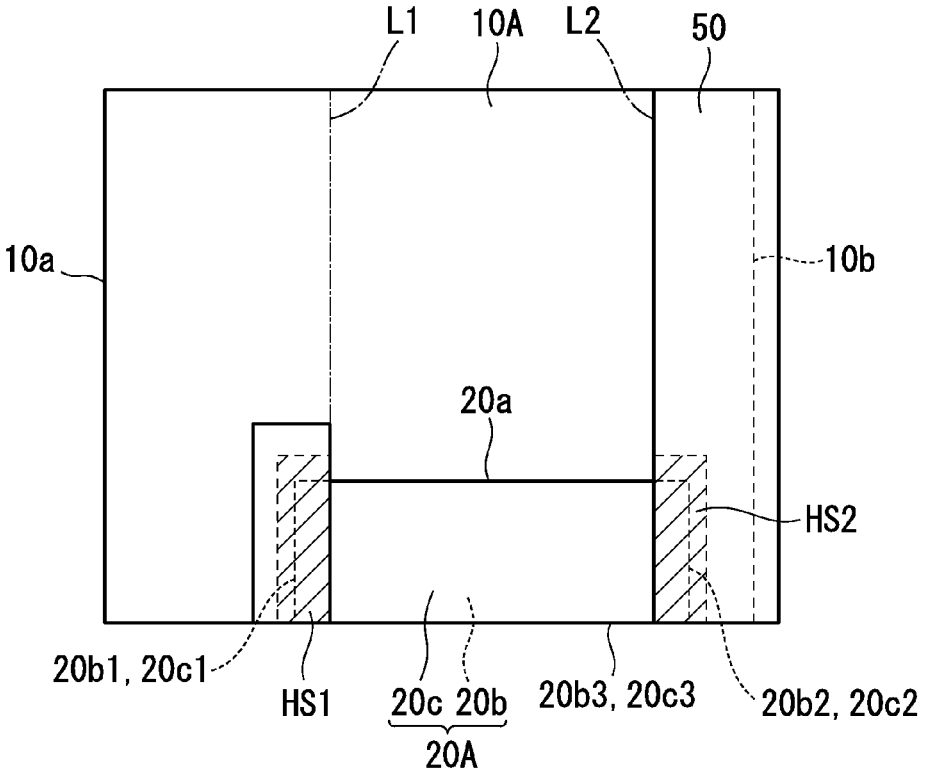
FIG. 18 is a plan view showing a process in the production method of a self-standing bag according to another embodiment of the present invention.

When the back seal 13 is formed close to the edge 15, as shown in FIG. 18, an adhesive member 50 which has the length from the upper end to the lower ends of the barrel member 10A and the width which is wider than the distance between the side edges 10*b* of the barrel member 10A and side edges 20*b*1 and 20*c*1 of the bottom member 20A instead of the adhesive member 42, is used as an adhesive member which adheres the side edges 10*a* and 10*b* of the barrel member 10A. The material of the adhesive member 50 is the same as the material given in the adhesive members 41 and 42.

Even when the back seal 13 is formed close to the edge 14, the same will apply.

Figure 19:
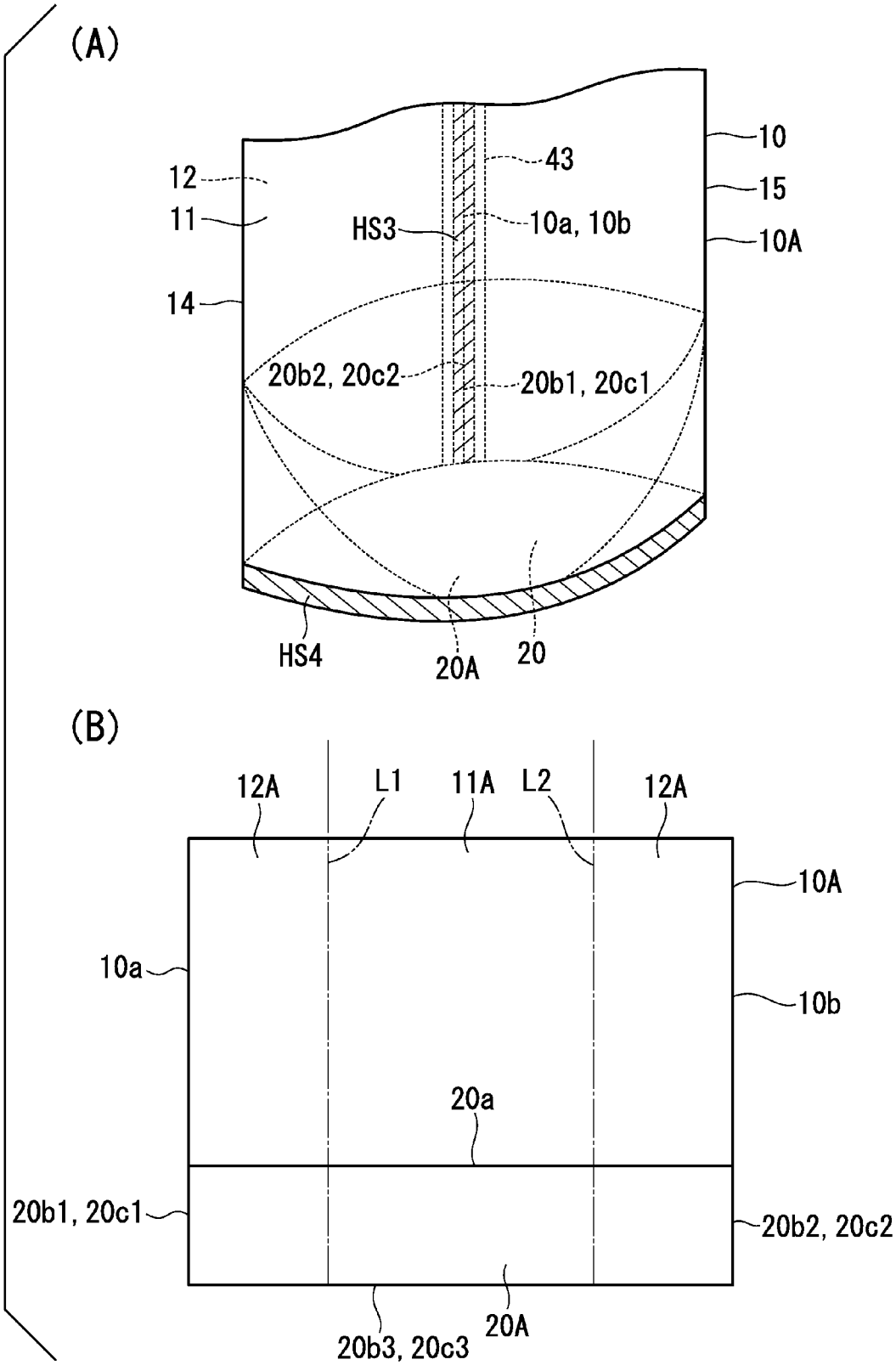
FIG. 19A is a perspective view partially showing a self-standing bag according to another embodiment of the present invention.
FIG. 19B is a plan view showing a process in the production method of a self-standing bag according to another embodiment of the present invention.

In the self-standing bag in the present invention, the side edges 20*b*1 and 20*c*1 and the side edges 20*b*2 and 20*c*2 of the bottom member 20A which are folded back at the edges 14 and 15 of the barrel portion 10 matches an adhesion position of the side edges 10*a* and 10*b* of the barrel member 10A in the barrel portion 10, and the adhesion of the side edges 10*a* and 10*b* of the barrel member 10A, the side edges 20*b*1 and 20*c*1 and the side edges 20*b*2 and 20*c*2 of the bottom member 20A, and the back surface portion 12 of the barrel portion 10 may be adhered by the adhesive member 43 as shown in FIG. 19A.

The self-standing bag is produced by using the barrel member 10A and the bottom member 20A where the length between both side edges of the barrel member 10A (the length from the side edges 10*a* to 10*b*), and the length between both side edges of the bottom member 20A (the length from the side edges 20*b*1 and 20*c*1 to the side edges 20*b*2 and 20*c*2) are formed approximately in the same size as shown in FIG. 19B. Since the self-standing bag is formed in a cylindrical shape such that the bottom member 20A is formed in the barrel member 10A, it is preferable that the length between both side edges of the bottom member 20A be slightly shorter than the length between both side edges of the barrel member 10A.

In the self-standing bag, the folding line 20*a* of the bottom member 20A is not fixed to the section 11A in the barrel member 10A as illustrated in FIG. 10. That is, the bottom portion 20 is not fixed at the edges 14 and 15 in the self-standing bag except the lower end of the barrel portion 10. Therefore, the self-standing bag spreads to the region a in the vicinity of the edge 14 of the barrel portion 10 in the bottom portion 20. Therefore, it is suppressed that the vicinity of the edge 14 of the barrel portion 10 is locally narrowed, and independent stability is improved to obtain a good appearance. In the self-standing bag, as shown in FIGS. 20A to 20C described below, when the form of the heat-sealed portion HS4 is changed, the barrel portion 10 and the bottom portion 20 are fixed in the edges 14 and 15 of the barrel portion 10 to further improve independent stability.

The above-described adhesive members 41 to 50 are not limited to a film having heat-sealing properties in both surfaces. For example, a film not having heat-sealing properties is used and the adhesive member may be adhered by an adhesive. In a method of using an adhesive, for example, since heat-sealing is not performed at the heat-sealed portions HS1 and HS2 in case of the self-standing bag 1, the outer surfaces of the side edges 20*b*1 and 20*b*2 in the bottom member 20A are not adhered to the inner surface of the back surface portion 12. Even when the film not having heat-sealing properties as an adhesive member is adhered by using the adhesive, the side edges 20*b*1 and 20*c*1 and the side edges 20*b*2 and 20*c*2 of the bottom member 20A are closed by the adhesive member and attached to the inner surface of the barrel portion 10. Therefore, the leakage of content is prevented.

Figure 20:
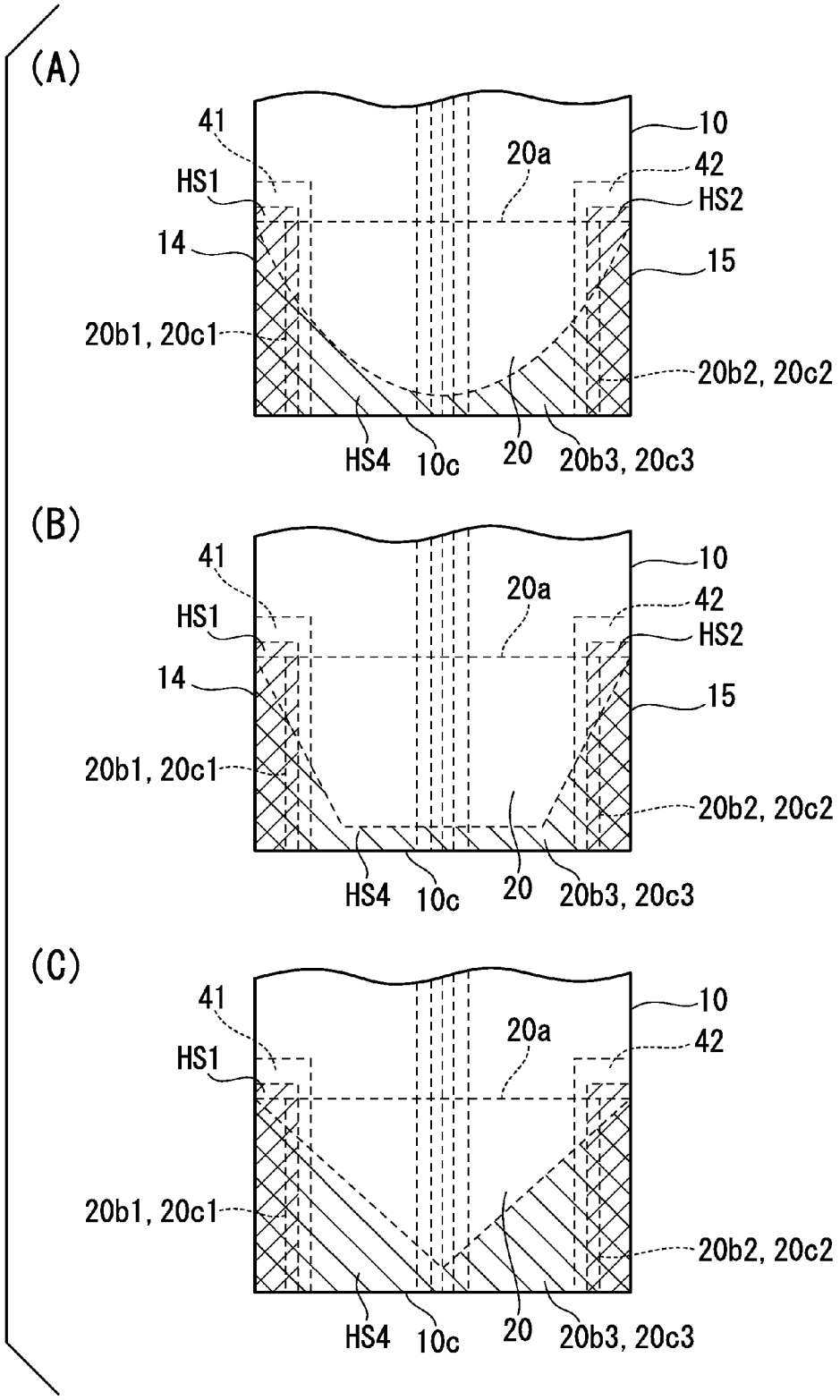
FIGS. 20A to 20C are front views showing a flattened state of the self-standing bag according to another embodiment of the present invention.

When the content is filled as shown in FIG. 20A, the bottom portion opens without sagging, and an upper edge of the heat-sealed portion HS4 in which the lower ends 20*b*3 and 20*c*3 of the bottom member 20A and the lower end 10*c* of the barrel portion 10 are adhered may be formed in an arc shape to improve independent stability. As shown in FIG. 20B, the heat-sealing may be performed so that the upper edge of the heat-sealed portion HS4 is formed in the shape of the folding line which is made up of three sides of a side which is inclined from the edge 14 to the lower end 10*c* of the barrel portion 10, a side which is parallel with the lower end 10*c*, and a side which is inclined from the lower end 10*c* to the edge 15. As shown in FIG. 20C, the heat-sealing may be performed so that the upper edge of the heat-sealed portion HS4 is formed in the shape of the folding line which is made up of two sides of a side which is inclined from the edge 14 to the center of the lower end 10*c* in the barrel portion 10, and a side which is inclined from the center of the lower end 10*c* to the edge 15. Further, when the whole surfaces are adhered in the heat-sealed portion HS4 shown in the FIGS. 20A to 20C, there is a possibility that wrinkles occur. Therefore, a non-seal portion may be provided in the range where the content does not leak.

It is preferable that the upper end of the heat-sealed portion HS4 matches the folding line 20*a* or be formed in a lower side of the folding line 20*a*. When the upper end of the heat-sealed portion HS4 is formed in an upper side of the folding line 20*a* of the bottom member 20A, the front surface portion 11 and the back surface portion 12 of the barrel portion 10 in the heat-sealed portion HS4 are unified in the upper side of the folding line 20*a*. Therefore, the section where the front surface portion 11 and the back surface portion 12 of the barrel portion 10 are unified functions like a knife edge, and when the barrel portion of the self-standing bag is grasped using one's hand, there may be an uncomfortable feeling. On the other hand, when the upper end of the heat-sealed portion HS4 matches the folding line 20*a* of the bottom member 20A or is formed in the lower side of the folding line 20*a*, the facing surfaces are not adhered since the bottom member 20A is folded in half in the state the basic material layers of the bottom member faces each other. In the edges 14 and 15 of the self-standing bag, the front surface portion 11 and the back surface portion 12 of the barrel portion 10 are not unified. Therefore, when the barrel portion of the self-standing bag is grasped using one's hand, the section which causes the uncomfortable feeling does not exist.

Figure 21:
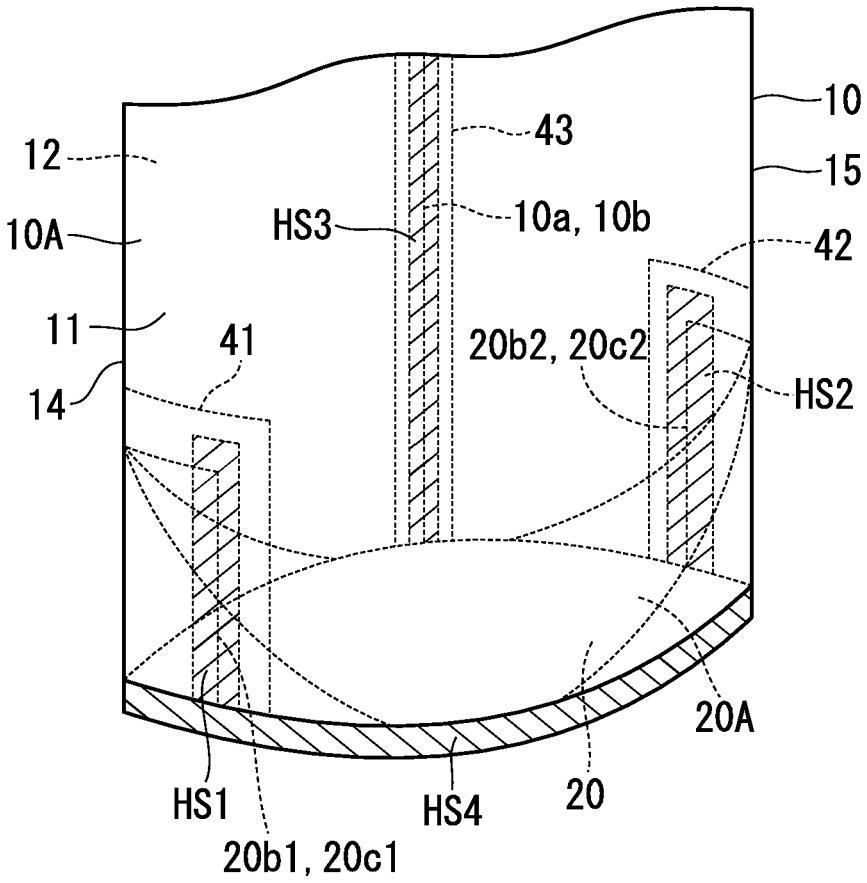
FIG. 21 is a perspective view showing the self-standing bag according to another embodiment of the present invention.

The side edges 20*b*1 and 20*c*1, and the side edges 20*b*2 and 20*c*2 of the bottom member 20A are attached to the inner surface of the back surface portion 12 in the self-standing bag 1. However, there may be the self-standing bag in which the side edges 20*b*1 and 20*c*1 and the side edges 20*b*2 and 20*c*2 are attached to the inner surface of the front surface portion 11. There may be the self-standing bag in which one of the side edges 20*b*1 and 20*c*1 and the side edges 20*b*2 and 20*c*2 of the bottom member 20A is attached to the inner surface of the front surface portion 11, and other is attached to the inner surface of the back surface portion 12. For example, there may be the self-standing bag in which the side edges 20*b*1 and 20*c*1 of the bottom member 20A are attached to the inner surface of the front surface portion 11, and the side edges 20*b*2 and 20*c*2 of the bottom member 20A is attached to the inner surface of the back surface portion 12 as shown in FIG. 21.

Figure 22:
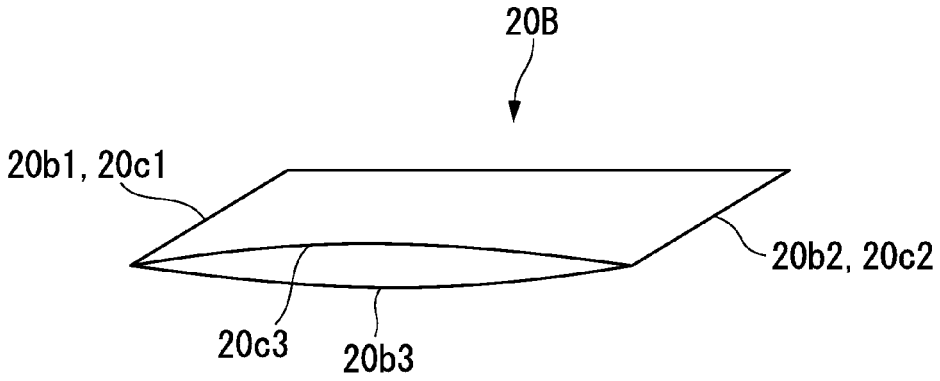
FIG. 22 is a perspective view partially showing a bottom member according to another embodiment of the present invention.
Figure 23:
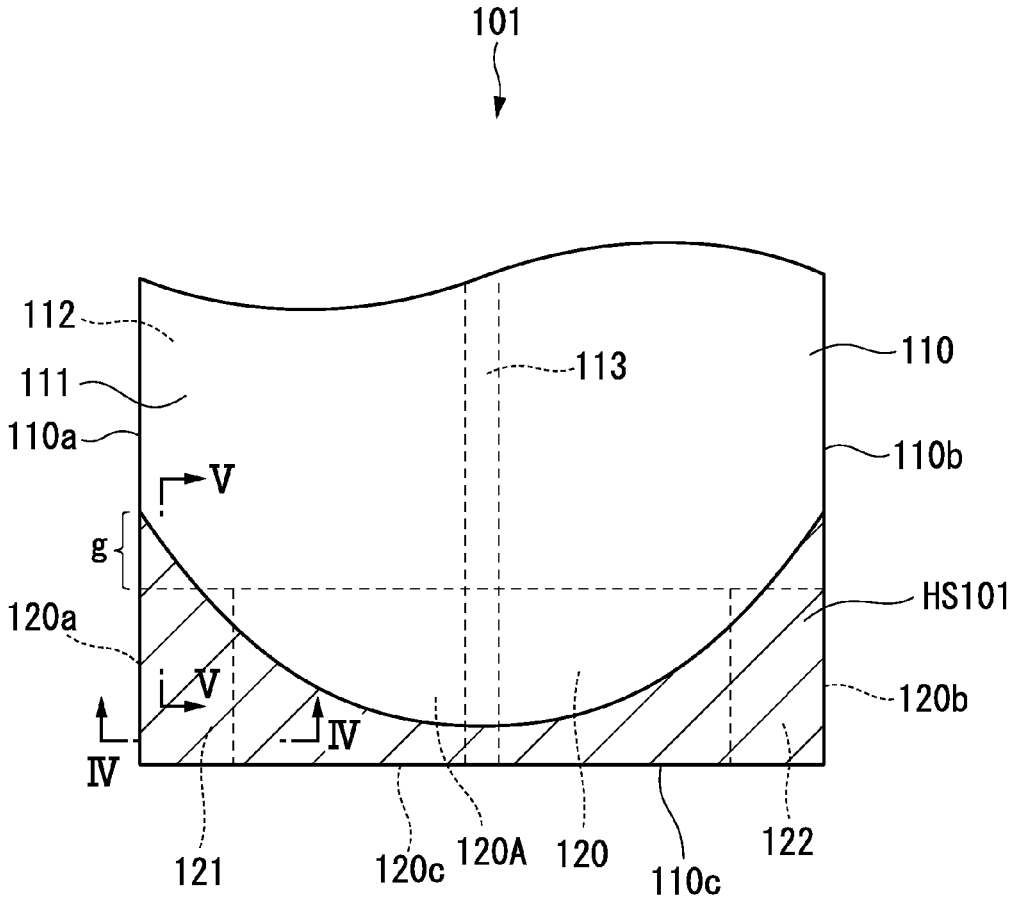
FIG. 23 is a front view partially showing a bottom portion in a flattened state of a self-standing bag in the related art.
Figure 24:
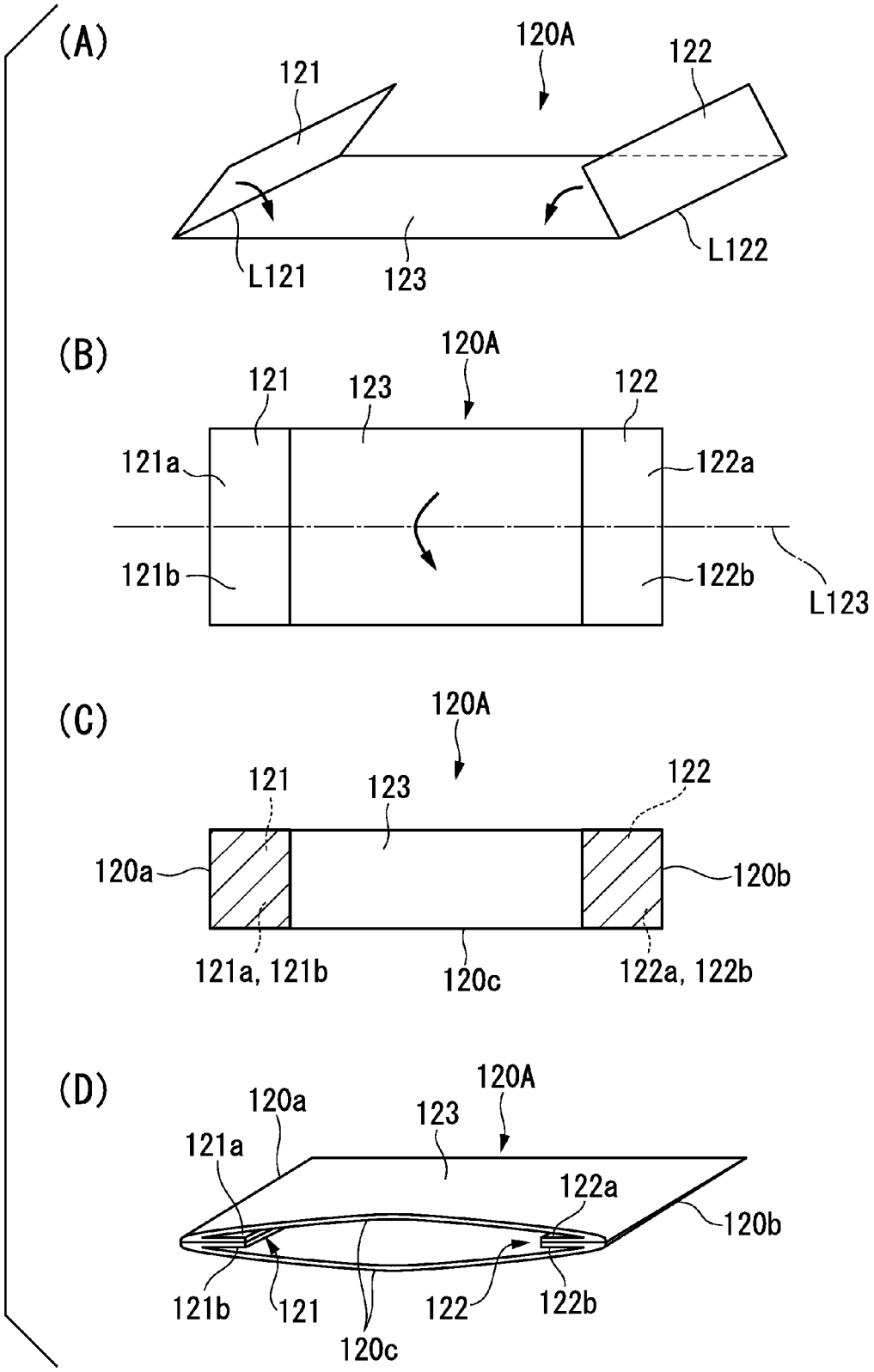
FIG. 24A is a perspective view showing a process of producing a bottom member of the pouch-shaped self-standing bag in the related art.
FIG. 24B is a plan view showing a process of producing the bottom member of the pouch-shaped self-standing bag in the related art.
FIG. 24C is a plan view showing a process of producing the bottom member of the pouch-shaped self-standing bag in the related art.
FIG. 24D is a perspective view showing a process of producing the bottom member of the pouch-shaped self-standing bag in the related art.
Figure 25:
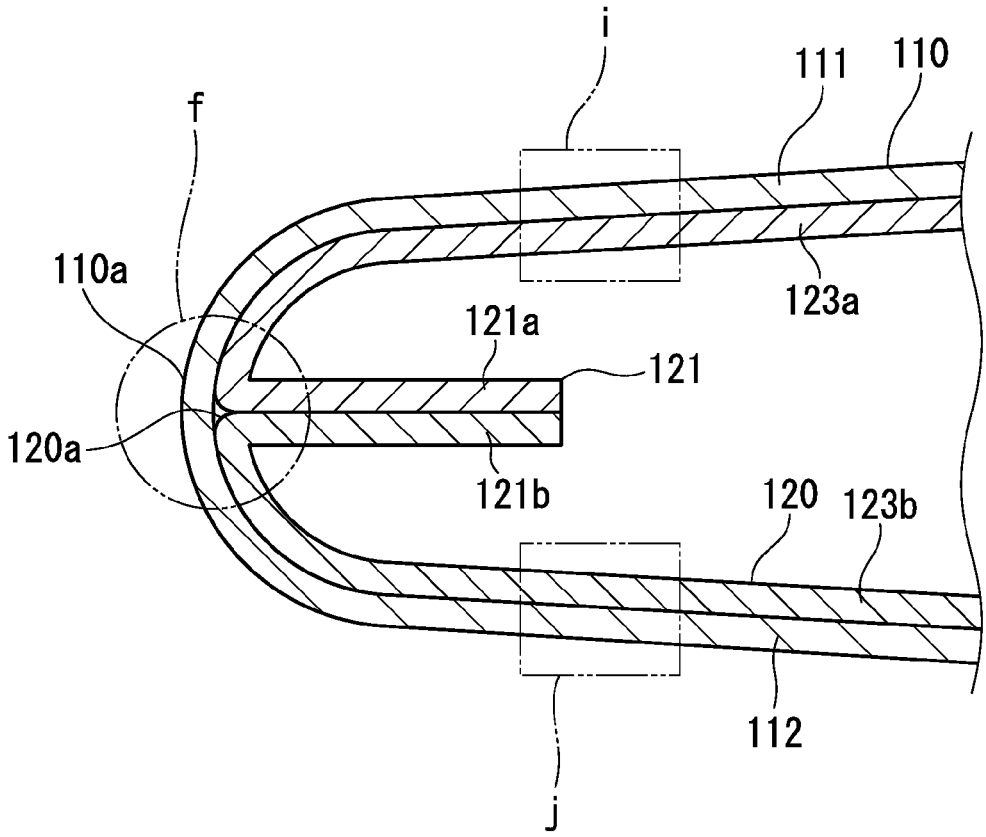
FIG. 25 is a cross-sectional view of the self-standing bag of FIG. 23 cut along a line IV-IV.
Figure 26:
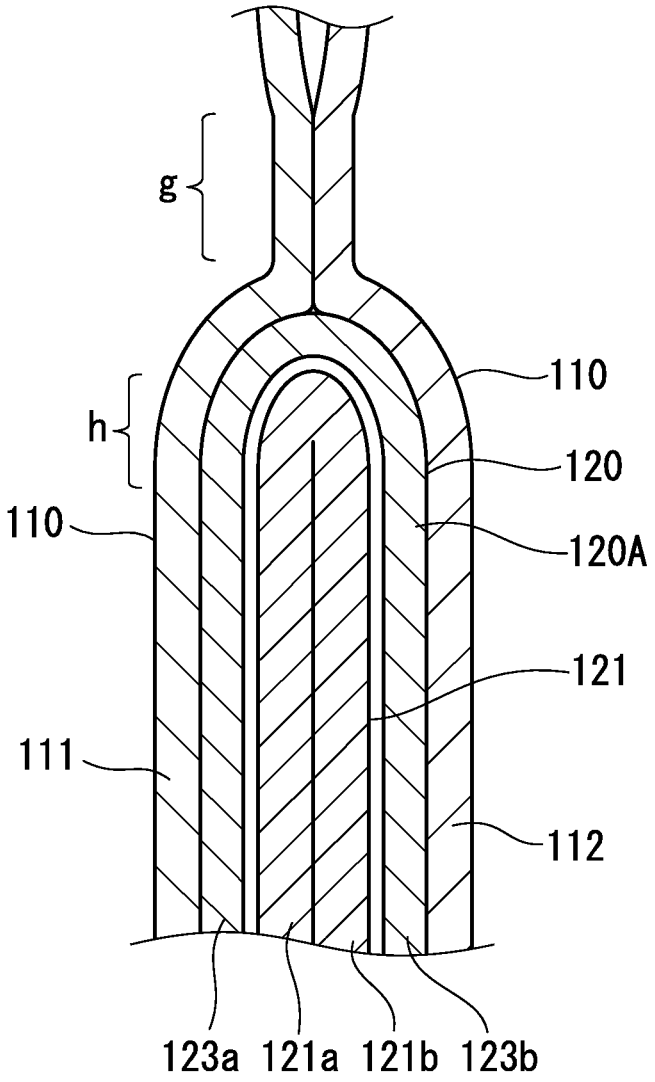
FIG. 26 is a cross-sectional view of the self-standing bag of FIG. 23 cut along a line V-V.

As shown in FIG. 22, a bottom member 20B having a flattened pouch shape in which the lower ends 20*b*3 and 20*c*3 are opened instead of attaching the bottom member 20A folded in half. The bottom member 20B has a structure in which the cylindrical film obtained by an inflation molding is weld-sealed in a vertical direction of an axis of the film, and the upper end is closed, a structure in which side edges of a film folded in half are weld-sealed and closed, and a structure in which side edge parts are folded inside and sealed like the bottom member 120A in the related art.

As the production method of a self-standing bag which is provided with the bottom member 20B, the same method of producing the self-standing bag 1 is used apart from the fact that the bottom member 20B is used instead of the bottom member 20A.

The barrel portion in the self-standing bag in the present invention may be formed in a cylindrical shape by folding back the side edges of the barrel member as described above, and may be formed with a film having a cylindrical shape which can be obtained by inflation molding without limitation of the back seal form.

The self-standing bag in the present invention is not limited to the embodiment with a spout. For example, the self-standing bag of which the upper portion of the barrel portion 10 may be opened and the self-standing bag in which a lid portion having the same shape as the bottom portion in the present invention is formed in the upper portion of the barrel portion 10 may be formed.

The self-standing bag having content therein is a bag in which the content is accommodated in the self-standing bag of the present invention.

The content is not particularly limited and for example, food such as beverages, ice cream, and jelly, fluids such as shampoo, hair conditioner, and soap, and powdery and solid-state solids are mentioned. In addition, the self-standing bag having content therein may be used as an exterior packaging bag which wraps individual packaging products.

INDUSTRIAL APPLICABILITY

According to the present invention, it is possible to suppress the leakage of content from adhesive defects and fractures at an adhesion section to obtain the self-standing bag without an uncomfortable feeling when grasped using the hand.

REFERENCE SIGNS LIST

1, 2: SELF-STANDING BAG
10: BARREL PORTION
10A: BARREL MEMBER
10*a*, 10*b*: SIDE EDGE OF BARREL MEMBER
10*c*: LOWER END OF BARREL MEMBER
11: FRONT SURFACE PORTION
12: BACK SURFACE PORTION
13: BACK SEAL
14, 15: EDGE OF BARREL PORTION
20: BOTTOM PORTION
20A, 20B: BOTTOM MEMBER
20*a*: FOLDING LINE
20*b*1, 20*b*2, 20*c*1, 20*c*2: SIDE EDGE OF BOTTOM MEMBER
20*b*3, 20*c*3: LOWER END OF BOTTOM MEMBER
30: SPOUT
41 to 50: ADHESIVE MEMBER

The invention claimed is:

1. A self-standing bag comprising:

a barrel portion where a barrel member is formed in a flattened cylindrical shape and which has a front surface portion and a back surface portion; and a bottom portion where a bottom member folded in half sets a folding line as an upper side and is attached to a lower end in the barrel portion, wherein side edge areas of the bottom member are folded back at edges of the barrel portion, and side edges of the bottom member are attached to an inner surface of the front surface portion or the back surface portion of the barrel portion, lower ends of the bottom member are adhered to the lower end of the barrel portion over the entire circumference of the barrel portion, and attaching the side edges of the bottom member to the inner surface of the barrel portion is performed by an adhesive member to adhere the side edges of the bottom member and the barrel portion so as to cover the side edges of the bottom member.

2. A self-standing bag comprising:

a barrel portion where a barrel member is formed in a flattened cylindrical shape and which has a front surface portion and a back surface portion; and a bottom portion where a bottom member with a flattened pouch shape opened at a lower end is attached in the barrel portion such that the lower ends of the bottom member match a lower end of the barrel portion, wherein side edge areas of the bottom member are folded back at edges of the barrel portion, and side edges of the bottom member are attached to an inner surface of the front surface portion or the back surface portion of the barrel portion, lower ends of the bottom member are adhered to the lower end of the barrel portion over the entire circumference of the barrel portion, and attaching the side edges of the bottom member to the inner surface of the barrel portion is performed by an adhesive member to adhere the side edges of the bottom member to the barrel portion so as to cover the side edges of the bottom member.

3. The self-standing bag according to claim 1, wherein both side edges of the bottom member folded back at the edges of the barrel portion correspond with a junction position of the side edges of the cylindrical-shaped barrel member in the barrel portion, and joining the side edges of the barrel member and adhering the side edges of the bottom member to the barrel portion are performed by the adhesive member.

4. The self-standing bag according to claim 1, wherein a section adhered to the adhesive member of the barrel portion is only the front surface portion or the back surface portion of the barrel portion where the side edges of the bottom member are attached.

5. The self-standing bag according to claim 1, wherein a spout which pours out accommodated content is attached to the barrel portion.

6. A self-standing bag having content therein in which the content is accommodated in the self-standing bag according to claim 1.

7. A production method of a self-standing bag comprising:

(I) arranging a film-like bottom member which sets a folding line as an upper end and is folded in half or a film-like bottom member formed in a flattened pouch shape with lower ends opened on a film-like barrel member so that a lower end of the barrel member matches the lower ends of the bottom member;

(II) arranging an adhesive member to adhere the barrel member and the bottom member so as to cover respective side edges of the bottom member arranged on the barrel member;

(III) adhering the side edges of the bottom member and the barrel member, and the adhesive member to attach the side edges of the bottom member to the barrel member;

(IV) forming a barrel portion by folding back side edge areas of the barrel member with side edge areas of the bottom member, and adhering the side edges of the barrel member such that a surface where the bottom member is adhered forms an inner surface and folding lines are formed in the center from both side edges of the bottom member; and (V) forming a bottom portion by adhering the lower ends of the bottom member and the lower end of the barrel portion over the entire circumference of the barrel portion.

8. The production method of a self-standing bag according to claim 7, further comprising (VI) performing point sealing on a step difference section at a boundary between a section formed by overlapping the bottom member and the barrel member and a section formed with only the barrel member in upper ends of the side edge areas in the bottom member after (II) or (III).

* * * * *